US005209098A

United States Patent [19]

Cudzik

[11] Patent Number: 5,209,098

[45] Date of Patent: May 11, 1993

[54] METHOD AND APPARATUS FOR FORMING CAN ENDS

[75] Inventor: Daniel F. Cudzik, Richmond, Va.

[73] Assignee: Reynolds Metals Company, Richmond, Va.

[21] Appl. No.: 716,715

[22] Filed: Jun. 17, 1991

Related U.S. Application Data

[63] Continuation-in-part of Ser. No. 530,506, May 31, 1990, abandoned, which is a continuation of Ser. No. 104,745, Oct. 5, 1987, abandoned.

[51] Int. Cl.[5] ..... B21D 45/05; B21D 51/44

[52] U.S. Cl. ..... 72/346; 72/348; 413/8; 413/56; 184/6.21; 184/6.26; 184/6.23

[58] Field of Search ..... 72/344, 345, 346, 361, 72/348, 444; 184/6.21, 6.23, 6.26; 192/129 A; 413/8, 56

[56] References Cited

U.S. PATENT DOCUMENTS

| | | |
|---|---|---|
| 543,711 | 7/1895 | Turner . |
| 1,747,463 | 2/1930 | Booth . |
| 1,846,319 | 2/1932 | Dister . |
| 2,585,047 | 2/1952 | Scibelli . |
| 2,691,428 | 12/1954 | Thomas . |
| 2,840,026 | 6/1958 | Eggert, Jr. . |
| 3,217,397 | 11/1965 | Voss . |
| 3,452,577 | 7/1969 | Schmeltzer et al. . |
| 3,481,431 | 12/1969 | Dorsey . |
| 3,537,291 | 11/1970 | Hawkins . |
| 3,664,172 | 5/1972 | Cvacho . |
| 3,768,295 | 10/1973 | Cudzik . |
| 3,844,154 | 10/1974 | Bozek . |
| 3,977,496 | 8/1976 | Black . |
| 4,169,520 | 10/1979 | Lewkowicz et al. . |
| 4,364,255 | 12/1982 | Byrd . |
| 4,450,938 | 5/1984 | Davenport et al. . |
| 4,513,600 | 4/1985 | Grow et al. . |
| 4,516,420 | 5/1985 | Bulso, Jr. et al. . |
| 4,549,424 | 10/1985 | Bulso, Jr. et al. . |
| 4,561,280 | 12/1985 | Bachmann et al. . |
| 4,567,746 | 2/1986 | Bachmann et al. . |
| 4,574,608 | 3/1986 | Bulso, Jr. et al. . |
| 4,587,825 | 5/1986 | Bulso, Jr. et al. . |
| 4,587,826 | 5/1986 | Bulso, Jr. et al. . |
| 4,611,481 | 9/1986 | Radtke . |
| 4,628,780 | 12/1986 | Hicks . |
| 4,704,887 | 11/1987 | Bachmann et al. . |
| 4,955,223 | 9/1990 | Stodd et al. . |
| 5,002,156 | 3/1991 | Gaunt . |

*Primary Examiner*—Bruce M. Kisliuk
*Assistant Examiner*—Jack Lavinder
*Attorney, Agent, or Firm*—Robert C. Lyne, Jr.

[57] ABSTRACT

Method and apparatus for forming can ends is disclosed wherein ends are blank from sheet material and formed in a die in which the completed end is formed and removed from the die at a vertical position below the blanking position. Formation and removal of the end beneath the cut line enables better control of the ends after forming. Vacuum is applied to the end underside to positively seat the end against lower die forming elements as the lower elements raise the end to the level of an ejection slot where pressurized air blows the air from between the dies. An automatic lubrication circuit for properly lubricating seal members forming pneumatic cushions for resiliently biasing the various die members is also disclosed.

23 Claims, 15 Drawing Sheets

METHOD AND APPARATUS FOR FORMING CAN ENDS

RELATED APPLICATIONS

The present application is a continuation-in-part of application Ser. No. 530,506, filed May 31, 1990 now abandoned, which is a continuation of application Ser. No. 104,745, filed Oct. 5, 1987, now abandoned.

TECHNICAL FIELD

The present invention relates generally to apparatus for forming can ends for two and three piece beverage containers.

BACKGROUND ART

Can ends are typically produced in a multi-operation process. In a first operation, circular blanks are cut from a sheet of the metallic end stock, typically aluminum or steel sheet, and the blank is formed into the basic end configuration, or "shell". In a second operation, a curl is produced on the outer periphery of the shell. (It is known to combine the curling operation within the blanking and forming die, but such operations are atypical and present problems of their own, and are of no concern to the present invention.) After curling, the end may be considered finished for some applications, but typically is further re-formed to include an easy-opening device, such as a ring pull tab or stay-on-tab. The term "ends" will be used herein to refer to shells, finished ends with easy-opening devices, and intermediate products in different stages of manufacture in between. Ends are sometimes called "lids".

The ever-increasing need for can ends in the beverage field has led can end producers to increase their productivity. Originally, can ends were formed in compound die processes having, for example, 2 to 4 pockets per press. (Each pocket has an upper die assembly and a lower die assembly.) Productivity increases in such presses were typically limited to speed increases of the press. Such speed increases have, for all practical purposes, reached their limit, and further substantial productivity increases in the older, smaller presses is unlikely.

Material usage is a major factor affecting can end prices. As mentioned, most compound dies in the past were of the two pocket type. Two finished ends per press stroke were stamped from a ribbon slightly wider than the blank size of 2 discs at 30° longitudinally. This manufacturing method provided approximately a 6% loss in the remaining web material, plus slitting charges incurred from reducing the wide mill width of about 60 inches to approximately 6 inches for press stock. Thus, instead of employing 60 inch coil slit ten times, with each strip creating 6% scrap plus slitting charges, a substantial dollar savings could be realized by processing the full width 60 inch mill strip.

A new generation of multi-out gang press-die systems was developed. These presses are double action multi-slide presses capable of stamping 20 ends per stroke from a 60 inch coil width. These systems are relatively low-speed and massive, with integrated ejection troughs and conveyors.

The one aspect of this "wide out" concept which was not fully appreciated was the new responsibility placed on the sheet rolling mill to make perfect, flawless 60 inch wide end stock. In the past, the mill had been able to recover a good percentage of the coil by selective slitting and scrapping. When full width coil is required, such salvage is not feasible, so high percentages of coil stock must be scrapped, re-melted, re-cast and re-rolled.

Thus evolved a need for a new method of manufacture, one that is capable of running at least ½ mill width coils, has 11-out dies, and preferably has the inherent capacity to utilize any width combination up to the ½ coil width. This concept dictates that since coil width is reduced, the speed must be increased to provide a suitable ratio of overhead to productivity.

In order to achieve this high-speed capability in a gang press, the entire, so-called "wide out" concept should be replaced. Double action presses are too massive for high speeds, the ejection method too irrational to achieve the control needed, and end handling too unpredictable to apply to a new high speed process.

While many of the older, smaller presses were of the relatively simple single action design, in which a single ram moves upwardly and downwardly against a complimentary die, the larger presses have been of the double action type, in which the ram has a pair of punch members which move upwardly and downwardly, with the inner die member moving within the outer die member and, for at least a portion of its travel, independently of the outer punch member. Such double action presses have, of course, added to problems of control of the system, due to their complexity. There is a need, therefore, for a single action can end press operable in the large press environment.

Another problem of greater proportions with the increased size of multiple station forming presses is the removal of ends from the die assemblies in the large production presses. Unlike smaller presses, in which each station (i.e., set of upper and lower die assemblies) could have its own independent receiving chute or other apparatus, there is insufficient room at the cut line level of the larger presses for individual lanes of exit chutes. Because of this, belts or other similar bulk removal means have been employed in these larger presses. Such means have proved to be substantially less reliable than the individual lanes available on smaller systems, increasing the chances of jamming of the ends during their removal from the die and thus necessitating shutdown of the press. There is also a need, therefore, for a can end forming system for high output presses which provides for control of the ends during their discharge from the die such that more precise control could be realized with tooling more serviceable toward high production.

DISCLOSURE OF THE INVENTION

In the present invention, a split level end forming system was created. This system of end fabrication provides for conventional single action die construction in conjunction with conventional single action high speed press usage.

The end forming system of the present invention requires that the coil and blank are processed on an upper level and the forming and discharge are completed on a lower level. Such a system automatically insures better control of the manufacturing process. The product ejection from the lower tooling provides for complete control of the end after formation, with absolute handling stability to the discharge conveyor. This rational control permits substantially higher manufacturing speeds and higher output with considerably smaller equipment.

Apparatus for forming metallic can ends in a press, in accordance with the present invention, comprises an upper die assembly and a lower die assembly, each of which has relatively vertically reciprocal die components. A cutting edge with which one of the upper and lower die assemblies cooperates to cut blanks from a sheet of metal stock is disposed between the assemblies. Selected ones of the die components are moved in one die assembly to coact with the die components of the other die assembly to form the ends from the blanks. A vacuum is applied through at least one of the lower die components to the underside of the formed end to positively seat the end on the lower die components as predetermined ones of the upper die components begin to separate from the end. The application of bottom vacuum affords better control over the formed end as it is brought into discharge alignment with the ejection slot by the upper and lower die components.

In some prior art shell presses, blow down air is provided through upper die components against the top surface of the formed end to keep the end from following the upper die components upward. However, end forming production by the present invention eliminates blow down air and simply ports to atmosphere the die forming region above the top surface of the end. This has been found to increase production rates by approximately 20%. Since atmospheric air quickly replenishes the vacuumized region at the bottom surface of the end upon vacuum release, the resulting pressure equalization greatly improves end stability immediately prior to and upon ejection of the end from between the dies. Atmospheric air is preferably supplied to the upper side of the formed end through an atmospheric air passage extending through one of the upper die forming members.

Vacuum may be applied to the end underside by a cam operated vacuum valve responsive to movement of the upper die assembly to precisely control the shut-off of vacuum as the upper die reaches a predetermined location. The vacuum valve also includes means for establishing ambient air pressure to the end underside immediately upon vacuum shut-off. Preferably, the cam operated vacuum valve includes a rotary valve mounted to a vacuum manifold having a first set of passageways connected to a vacuum source and a second set of passageways communicating with ambient pressure air. Means having a cam slot movable in response to movement of the upper die is provided and a cam follower engages the slot to mechanically rotate the valve and thereby selectively establish and positively control communication between the end underside with both vacuum and ambient pressure air, as aforesaid.

The end forming apparatus of the invention is mounted in a press including a crank mechanism for reciprocating the upper die into and out of high-speed forming contact with the lower die. The cam slot is mounted to move synchronously with the upper die in reciprocating strokes. The upper die is mounted to a crank driven punch shoe and the cam slot may be formed in a punch bar connected to project from the shoe towards the vacuum valve so as to receive the cam follower in the cam slot.

In accordance with another feature of this invention, the upper forming surfaces of each lower die component is brought to a discharge position, after forming, which is coelevational with each other to define the bottom of an exit slot between the upper and lower dies. This bottom is also coelevational with the bottom surface of an entrance end of an ejection slot formed immediately adjacent the exit slot. Pressurized air is directed against a side of the formed end which is opposite the ejection slot to rapidly eject the formed end from between the upper and lower die assemblies.

More specifically, the lower die assembly includes a bottom die core engageable with the underside of the blank for forming the center portion of the formed end. It is the uppermost forming surfaces of this die core which are raised into coelevational alignment with the other upper forming surfaces of the lower die components immediately prior to end release.

The present invention also features pneumatic cushions for resiliently biasing selected ones of the upper and lower die components during the forming process. These pneumatic cushions are defined by seal members disposed between appropriate ones of the upper and lower die components.

To attain continuous high-speed production, the present invention features a system for lubricating the individual seals with a precise amount of lubricated air provided to the cushions through a lubrication circuit. This circuit includes a lubrication reservoir and a mister which atomizes the lubricant from the reservoir to form lubricated air. The pressure of this lubricated air is regulated and supplied to the pneumatic cushions through an inlet valving arrangement. During lubrication, this lubricated air is continuously exhausted from the pneumatic cushions through an outlet valving arrangement. The exhausted lubricated air is discharged to atmosphere after passing through a coalescing filter which removes remaining lubricant from the air prior to discharge.

By providing precisely metered amounts of lubrication to the seals in the novel manner set forth above, the seal members are adequately lubricated for prolonged seal life. Furthermore, by continuously venting the pneumatic cushions during the lubrication process, stagnant air otherwise present in the pneumatic cushions is exhausted, which prevents undesirable accumulation of lubricant on the seals while avoiding water condensation which would congeal with the oil.

The lubrication circuit preferably features computer controlled solenoid inlet and outlet valving arrangements to provide for automatic lubrication of the seals at desired intervals such as when changing a coil of metal stock being supplied to the die to form the blanks.

The lubrication circuit of the present invention is not limited to production of end forming dies and may be utilized in any apparatus which includes one die member for forming a stock material into a predetermined shape, and wherein the die member is resiliently biased during its forming stroke by means of pressurized fluid entering a cavity provided with at least one seal member.

In a commercial embodiment of this invention, the upper and lower die assemblies are respectively mounted to a punch shoe and a die shoe connected together by means of guide posts which precisely align the die assemblies together. This arrangement, as a self-contained unit, is installed in a crank operated press whereby the crank mechanism reciprocates the upper die assembly under press power in forming strokes. The cutting edge is mounted within a cut edge holder plate connected to extend above the die shoe so as to position the cutting edge in operative alignment with the upper and lower die assemblies.

In accordance with a further unique feature of the invention, means are provided for lifting the holder plate from the die shoe to gain access to the lower die components using press power. Such lifting means preferably include a homing block fixed to project downwardly from the punch shoe and movable with the punch shoe. A lower end of the homing block is substantially coelevational with the holder plate in a bottom dead center position of the upper die assembly. In this position, a lift pin may be inserted through aligned bores in both the homing block and holder plate to lock them together and thereby lift the holder plate (upon unfasteninq of securing bolts) to access the bottom die elements.

A stripper plate is mounted to extend above the holder plate. This stripper plate also includes a bore which enters into coaxial alignment with another bore in the homing block, in the bottom dead center position of the upper die assembly. The lift pin is selectively insertable into this second set of bores to selectively lift the stripper plate from the holder plate.

A method of forming metallic can ends in a press utilizing upper and lower die assemblies is also disclosed. The method comprises the steps of feeding metallic stock across a die forming axis with the upper die assembly located above the stock in coaxial alignment with the lower die assembly. The stock is cut into a circular blank by moving the upper punch assembly in its downstroke into contact with the stock in cooperation with a cutting edge disposed therebelow. The blank is formed by directing it further downward into contact with the lower die assembly so that die components of the upper and lower die assemblies coact with each other to form the end. A vacuum is applied through one of the lower die components to the underside of the formed end to positively seat it on the lower die components during the upstroke of the upper die assembly. The vacuum is released as selected ones of the upper components begin to separate from the formed end to enable high-speed ejection from between the upper and lower die assemblies.

Still other advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1:
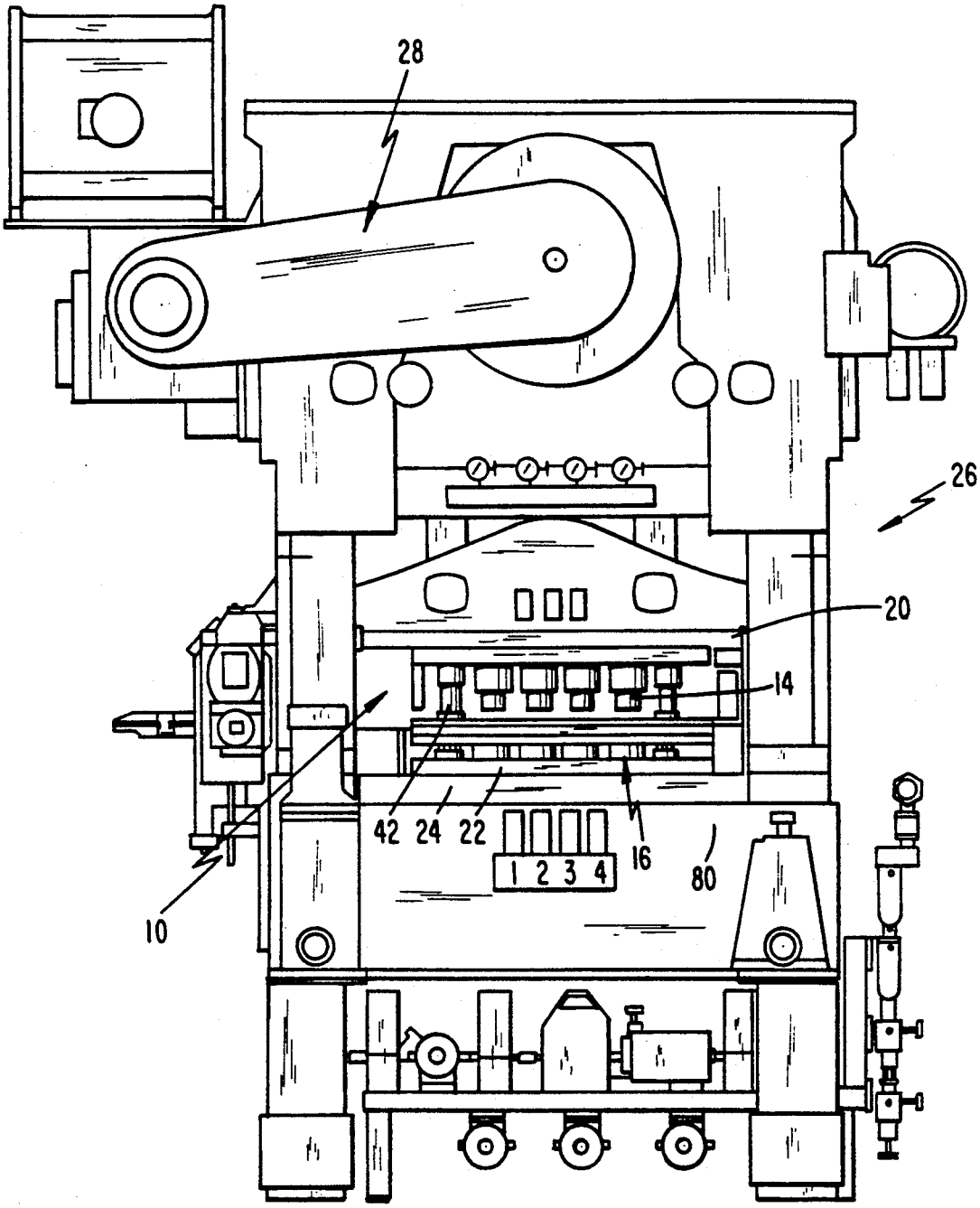
FIG. 1 is an elevational view, partly in schematic form, of an end forming system of the invention mounted within a press.

Referring to FIGS. 1–3 and 7, the end making system 10 of the present invention may be embodied in a four-out, in-line die arrangement comprising four of dies 12, each die including an upper die assembly 14 and a lower die assembly 16. The individual tooling members of the upper and lower dies 14,16 will be described more fully below, when discussing the forming sequence within each die 12. Briefly, however, the pneumatically cushioned upper die 14 is mounted for vertical reciprocation to a punch shoe 18 fixed to extend below an adapter plate 20 defining the uppermost extent of the end making machine 10. The lower die 16 also contains pneumatically cushioned forming members projecting upwardly from a die shoe 22 which is in turn fixed to a lower bolster plate 24 with bolts 26. The end making machine 10, inclusive of the top adapter plate 20 and bottom bolster plate 24, is movable as a self-contained, single unit capable of being installed within a conventional press, such as an upright, single action Bruderer 60 ton press wherein a crank mechanism 28 reciprocates the upper dies 14, by displacing the adapter plate 20, in the forming sequence set forth below.

Figure 2:
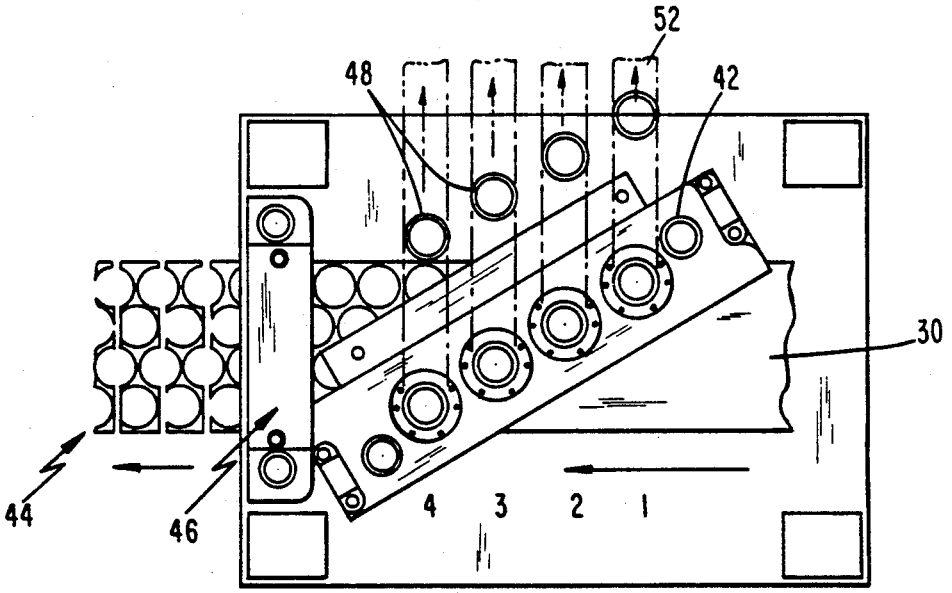
FIG. 2 is a plan view, partly in section, depicting the feed of stock into and out of a four-out die comprising upper and lower die assemblies of the invention.
Figure 3:
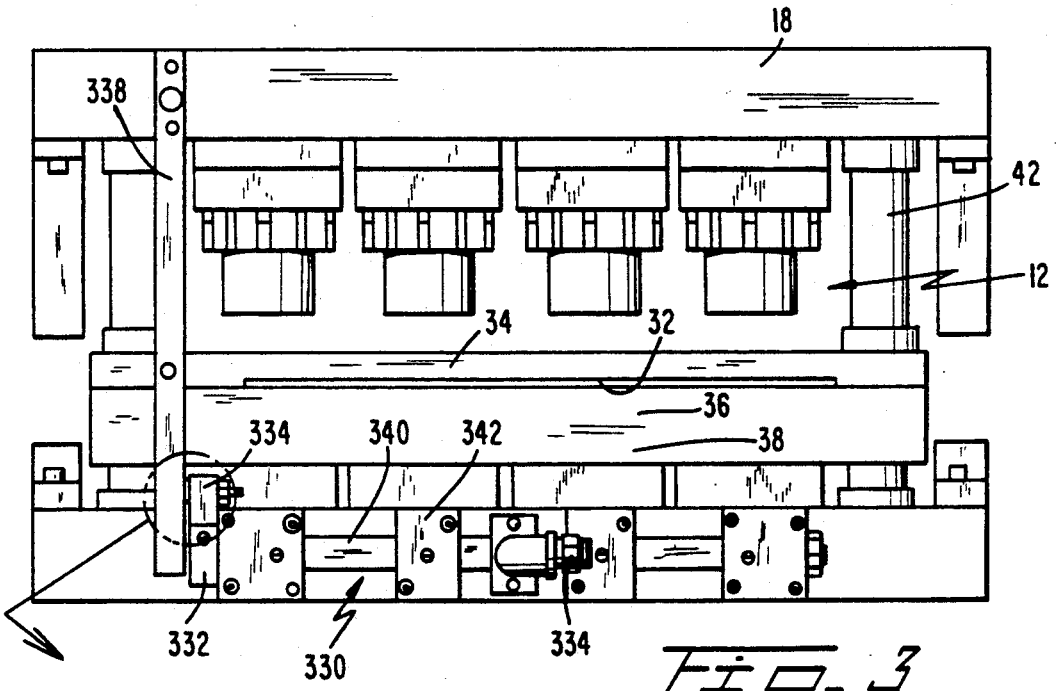
FIG. 3 is a front elevational view, partly in section, of the end machine making and a rotary vacuum manifold valve.
Figure 3A:
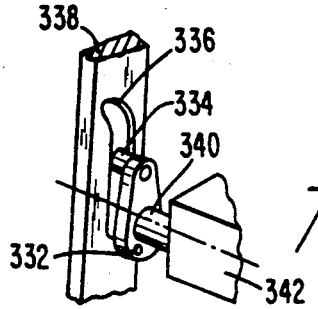
Figure 4:
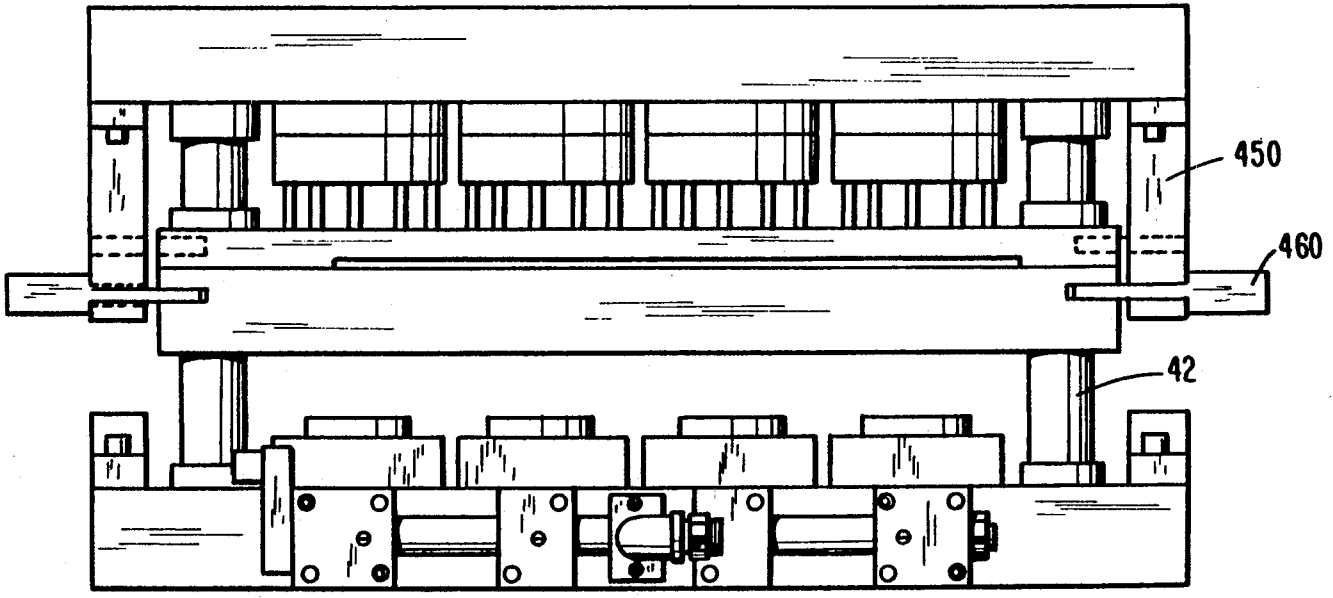
FIG. 4 is a view similar to FIG. 3 depicting press power lifting of cut edge holder plate and stripper plate assemblies in a die service mode of the invention to provide easy access to the bottom die forming members.

With reference to FIGS. 2 and 3, end stock 30 is fed through a horizontal feed slot 32 formed between a stripper plate 34 and a cut edge holder plate 36 bolted at 37 (FIG. 7) to each of the die shoes 22 through a cut edge support plate 38. The stripper plate 34 and support plate 38 extend the length of the end making machine 10. Vertical guide posts 42, mounted at opposite ends thereof to the bolster plate 24 and adapter plate 20 and extending through the stripper plate 34 and cut edge support plate 38, provide precise alignment between the upper and lower dies 14,16 at each die station during the forming process.

Upon exiting from the die assemblies 12, the punched stock 44 is fed through a scrap chopper assembly 46. The formed ends 48 are ejected from between each upper and lower die assembly 14,16 through a series of ejection slots 50, discussed infra, extending perpendicular to the stock feed path and rearwardly from the machine 10 where the ends are directed through discharge chutes 52 to a curler (not shown) which completes the end for assembly.

FORMING SEQUENCE

The basic operation of each die 12 is sequentially depicted in FIGS. 5A-5J which show how the die cuts, forms and ejects the formed end shells 48. Briefly, however, each die 12 consists of components hardened and ground to close tolerance, and highly polished in the areas that have metal contact. Each upper die assembly 14 includes a punch shell 54 used to blank a disk through the cut edge 56 and carry the disk down to be formed over the die center 58 and die core 60. A punch core 62 in the upper die assembly 14 forms the countersink and sets the center panel radius at the bottom of the stroke. Total entry of the punch shell 54 into and downwardly from the cut edge 56 may be approximately 1.211". An upper draw ring 64 is pneumatically operated to hold the blank while forming the end 48. This ring 64 also serves as a shedder to remove the end 48 from the punch shell 54. The die center 58 engages the upper draw ring 64 to hold the blank while forming. A re-form piston 66 in the bolster plate 24 is pneumatically pressurized to lift the die core 60 through a pilot die core 68 to the proper height to form the center panel as the die tooling is moving upward. A secondary draw ring 70 is pneumatically pressurized to add 1200 lbs. clamping force to hold the upper draw ring 64 in place for the first 0.128" of the upward stroke of the ram. A lift ring or shedder 72 is pneumatically operated to lift the die core 60 to a position where it provides a smooth base for the end 48 to rest on as it is being blown out of the die tooling space. The lift ring 72 is designed to stop approximately 0.003" above the die center 58. The die core 60 rests approximately 0.001" below the lift ring 72. A lower draw ring 74 stops at the same level as the die center 58. This allows for the smoothest possible path for ejecting the end 48. Fiberoptic sensors (not shown) may be used to monitor the ends 48 being ejected from the die into the ejection slots 50. If a misfeed or jammed end should occur in one of the die stations, the press 26 will stop at top dead center (TDC) within one stroke of the ram.

Figure 5A:
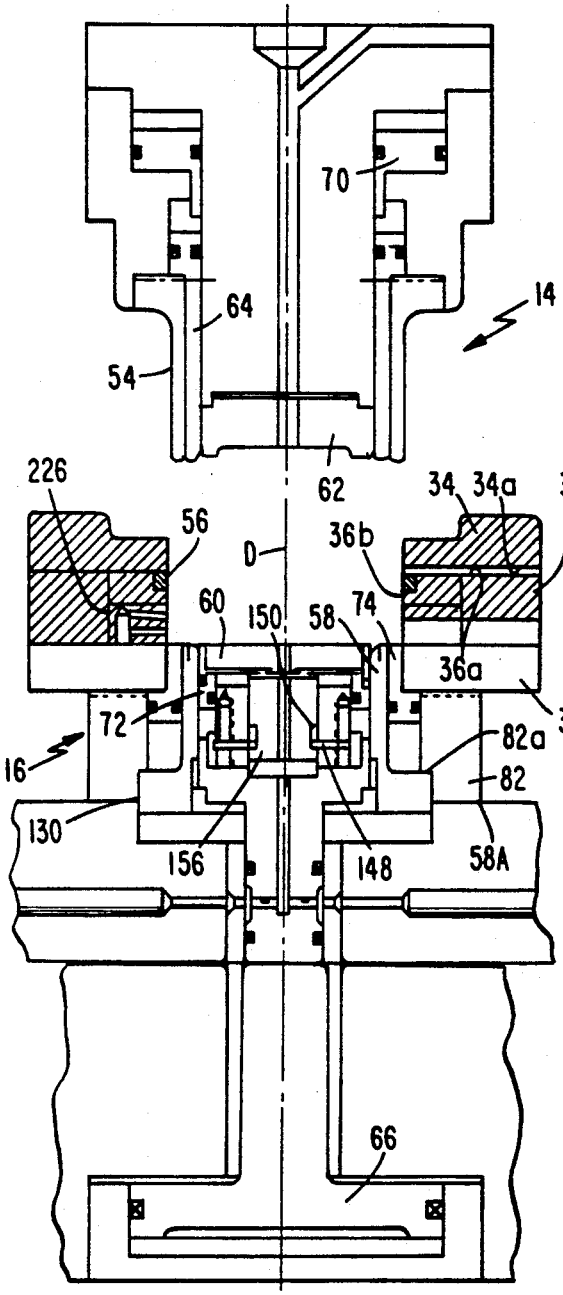
FIGS. 5A–5J are sequential views depicting the forming process in detail.

In FIG. 5A, the ram or upper die 14 is at zero degrees, or top dead center (TDC). The metal stock 30 is halfway through its feed cycle and extends through the punch cavity along a stock feed line F orthogonal to the die forming axis D. This feed line F is coplanar with stock infeed slot 32 and a scrap outfeed slot respectively formed on opposite sides of the die cavity between the bottom surface 34*a* of stripper plate 34 and the top surface 36*a* of cut edge holder 36 plate bolted to the die shoe as at 37. Both the upper and lower dies 14,16 are respectively spaced above and below the stock 30 which is bottom supported in the die cavity with the cut edge 56 contained within the holder plate 36. Both the primary and secondary upper draw rings 64,70 are pneumatically fully extended on the top or punch side of the die 14 downwardly towards the stock 30. The lower draw ring 74, lift ring 72 and die core assembly 60 are fully extended on the bottom of the die 16 upwardly towards the stock 30.

Figure 5B:
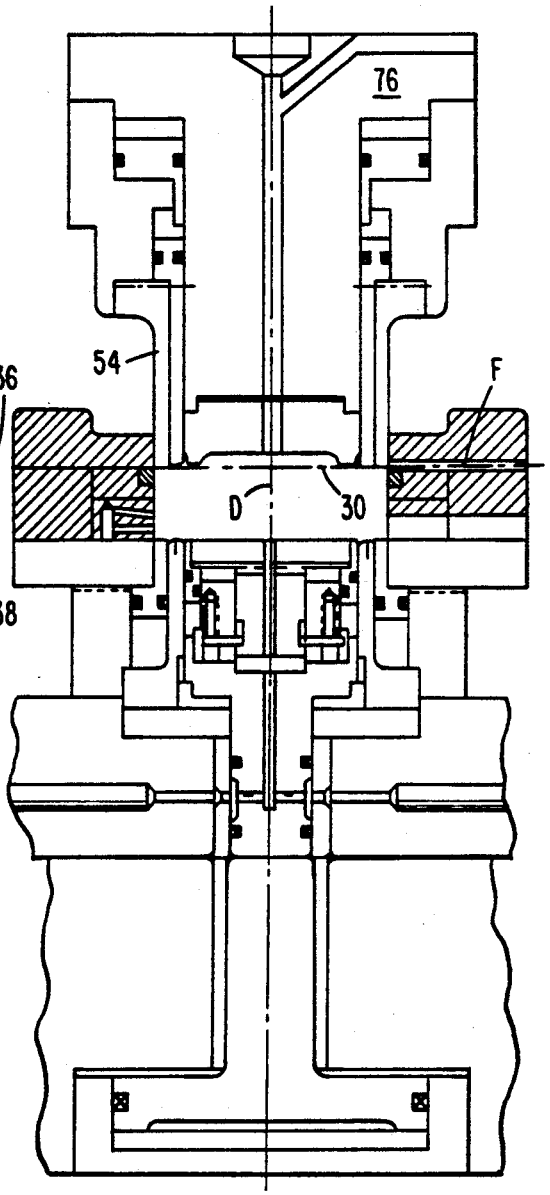
Figure 6:
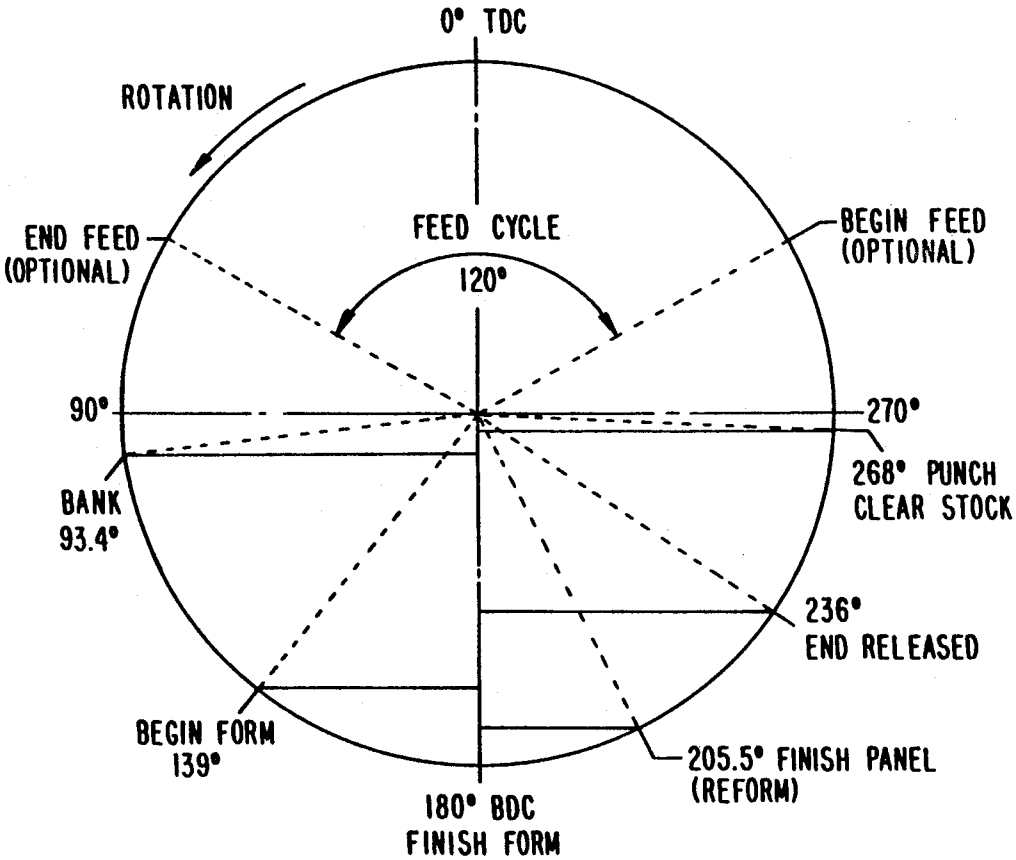
FIG. 6 is a press timing diagram.

In FIG. 5B, the ram is at 93.4° (see timing diagram — FIG. 6) on its downward stroke. The stock infeed advance is completed and the blank 30 is cut by the action of the descending punch shell 54 against the cut edge 56. The stock feed pinch rolls (not shown) are still holding the stock. The blank 30 is a circular blank of metal, preferably aluminum, as well known in the art. As can be seen in this figure, the punch shell 54, along with the draw ring 64 and punch center or core 62 are moving downwardly in unison under the action of the press crank 28. As will be discussed more fully below, all these die elements are mounted to the punch shoe 18 through the punch shell 54 and a punch holder 76 bolted to the punch shoe and slidable within and along a vertical cylindrical wall (die opening) defined by the cut edge 56 and cut edge holder plate 36.

Figure 8:
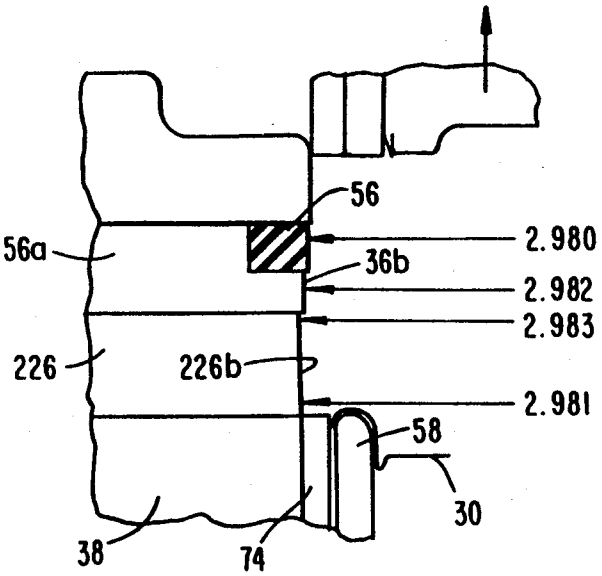
FIG. 8 is an enlarged cross-sectional view depicting a further feature of the invention.

Since the blank 30 is carried downwardly by the upper forming members through the cut edge holder plate 36 towards the bottom forming members, a constant diameter die opening between the cut edge 56 (diameter 2.980 inches) and support plate 38 tended to cause "galling" of the peripheral edge of the cut blank. To prevent this problem, as depicted in FIG. 8, the diameter of the die opening 36*b* in the cut edge holder ring 56*a* (2.982 inches) and the coaxial opening (2.983 inches) in the spacer 226 are of progressively slightly larger diameter than the diameter (2.980 inches) of the cut edge. However, since the blank 30 is actually formed at a location considerably below the holder plate 36, at which location the diameter of the support ring 226 is less than the stepped out diameters of the holder plate die opening, the blank tends to be off-center at the time it is placed into forming contact with the die center as discussed more fully below. This off-center contact causes "earring" to occur in the finished peripheral edge of the formed end at approximately 45° intervals to the grain direction. To eliminate this problem, the die opening 226*b* in the cut edge spacer ring 226 is preferably formed with a progressively decreasing diameter in the direction of the lower forming members to re-center the blank with the die center 58 before forming begins.

The die opening 226*b* may be machined with a diameter which decreases from a maximum diameter (e.g., 2.983 inches) to a diameter (e.g., 2.981 inches) corresponding to the outer diameter of the cut edge 56. Alternatively, circumferentially spaced rider bars (not shown) may be disposed along the cut edge support plate die opening to provide the desired re-centering. In this manner, the problems of "galling" as well as the resulting problem of "earring" are both advantageously avoided.

Figure 5C:
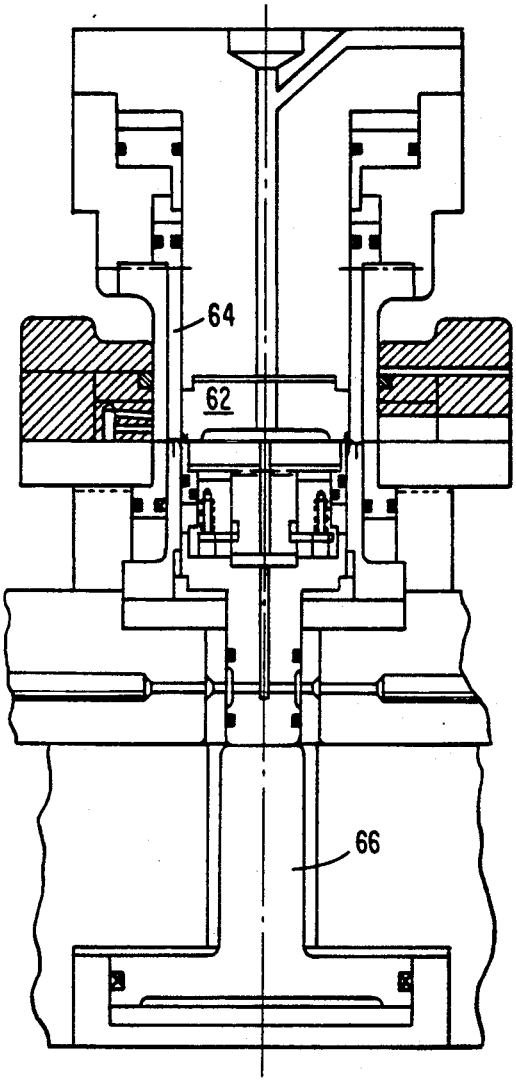

In FIG. 5C, the ram is at 139° on its downward stroke. The punch 54 has continued its downward travel and the upper die members have begun their interaction with elements connected to the lower die. At the point depicted in FIG. 5C, the blank 30 is pinched between the upper draw ring 64 and the die center 58 and the outermost peripheral edge of the blank is trapped between the bottom edge of the punch shell 54 and the top edge of the lower draw ring 74. The upper draw ring 64 has ceased its downward motion due to the fixedly mounted die center 58 which is mounted to prohibit any downward motion thereof. The punch shell 54 and the punch core 62 continue their downward movement with the punch base or lower draw ring 74 (co-acting with the punch shell) and the lift or shedder ring 72 (co-acting with the punch core 62) moving downwardly in response to the advancing downward movement of the punch shell and core. During this motion, the blank is free to move between the punch shell 54 and lower draw ring 74 and slides out from between them, while wrapping around the fixed die center 58 to begin the formation of the seaming panel of the end.

Figure 5D:
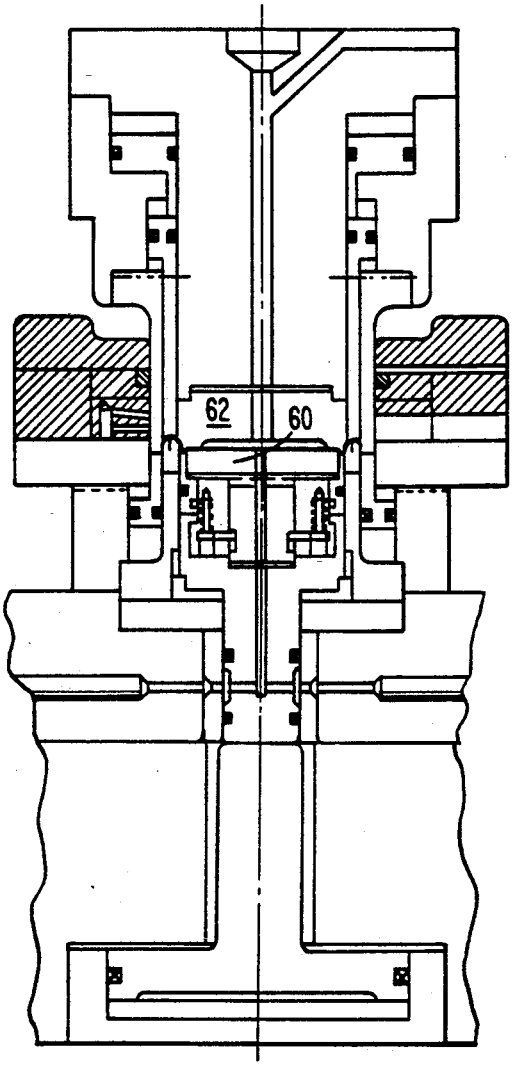

In FIG. 5D, the ram continues its down stroke. At a crank angle of approximately 155° (at re-form height 0.128 from BDC), the end is partially formed. More specifically, the punch shell 54 and lower draw ring 74 have continued their downward motion but the peripheral edge of the blank has now been completely removed from between these elements and has wrapped around the die center 58. The punch core 62 and lift ring 72 are also continuing their downward path and the bottom die core 60 now begins forming the center panel as it is contacted by the descending punch core 62 engaging the upper surface periphery of the center panel.

Figure 5E:
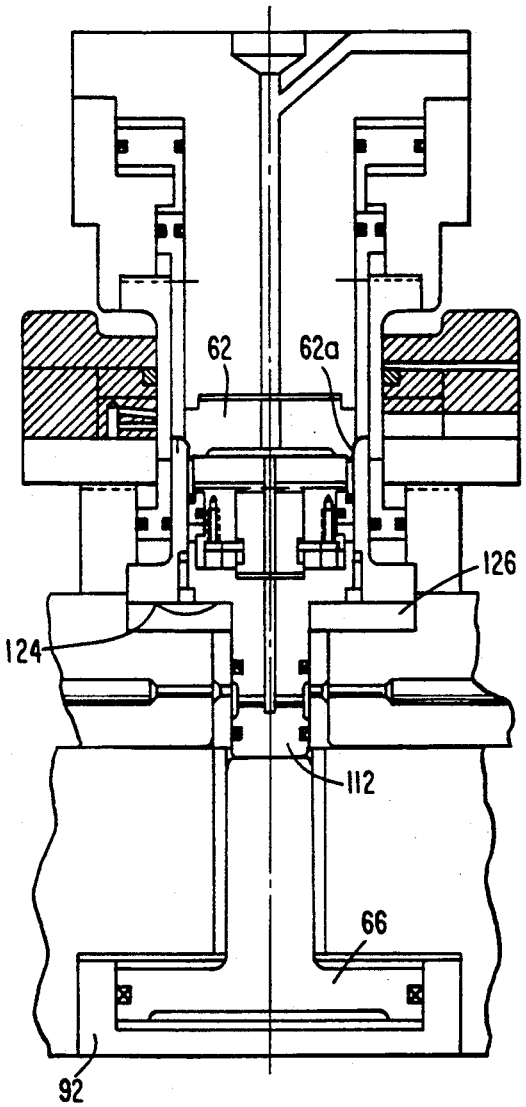

In FIG. 5E, the ram is at 180° or bottom dead center (BDC). The re-form piston 66 is depressed approximately 0.128 inches for panel redraw. In reaching their bottommost position, the punch core 62 and the lift ring 72 have continued their downward movement, causing metal of the blank to wrap around the nose 62*a* of the punch core while at the same time metal continues to be pulled from between the upper draw ring 64 and the die center 58 such that the punch center radius of the blank is formed. In this manner, the countersink and preform panel and lip are complete. The center panel is preformed to start the metal reversal which forms the panel on the upstroke. A vacuum is applied to the lower tooling, as described hereinbelow, to prevent the end from rising up with punch 54 as it withdraws in its upstroke from the forming area.

Figure 5F:
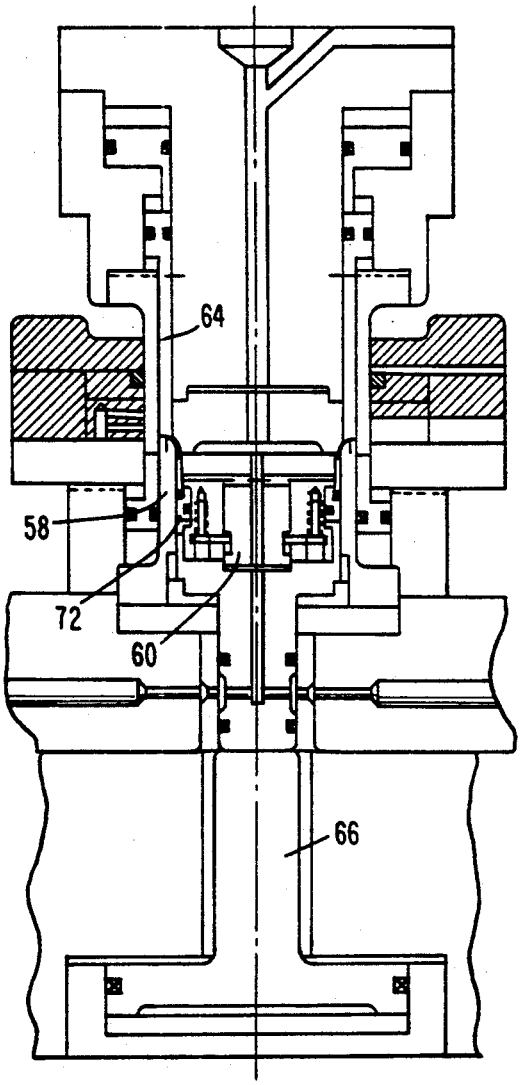

In FIG. 5F, the ram is at 205.5° on the way up. The die core 60 has moved up by the action of the re-form piston 66 to a predetermined height (0.128), to form the center panel. The reform piston 66 will dwell here until the next stroke. The bottom die core 60 and lift ring 72 will dwell here until the upper draw ring 64 retracts from the end.

Figure 5G:
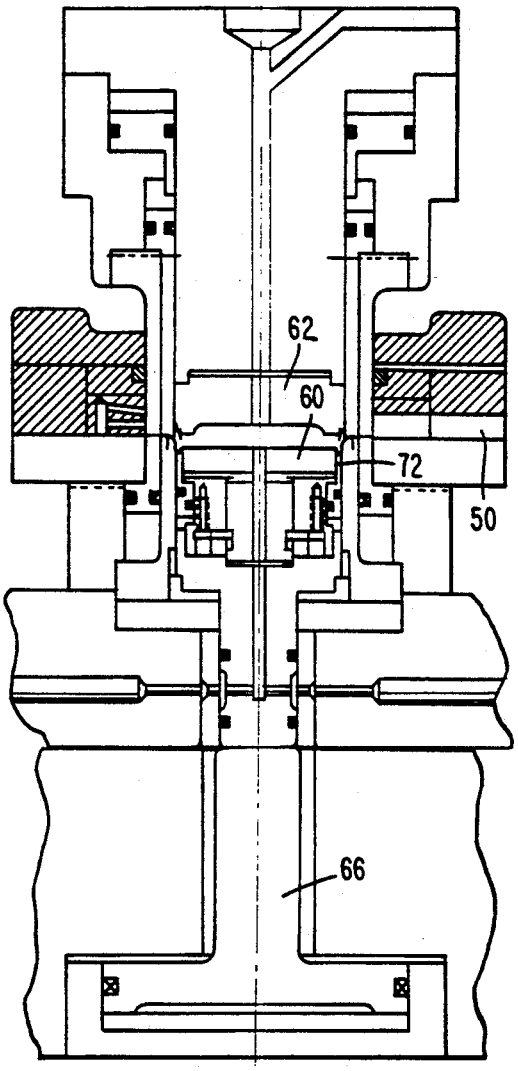

In FIG. 5G, the ram is at 230° on its upstroke. The punch core 62 has lifted off the end. The die core 60 and lift ring 72 are still in dwell and have completed the re-forming of the center panel. The lift ring 72 is pressurized to approximately 15 psi of lift which low pressure is just enough to lift the ring 72 and die core 60 to the position depicted in FIG. 5G when the end is released, but not enough to distort or form the end beyond what was done by the re-form piston 66.

Figure 5H:
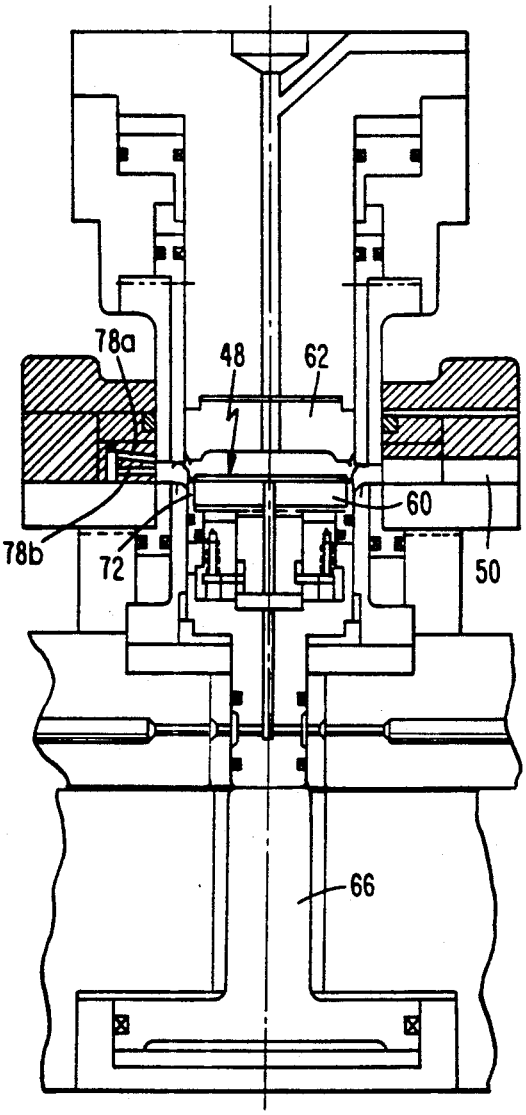
Figure 5I:
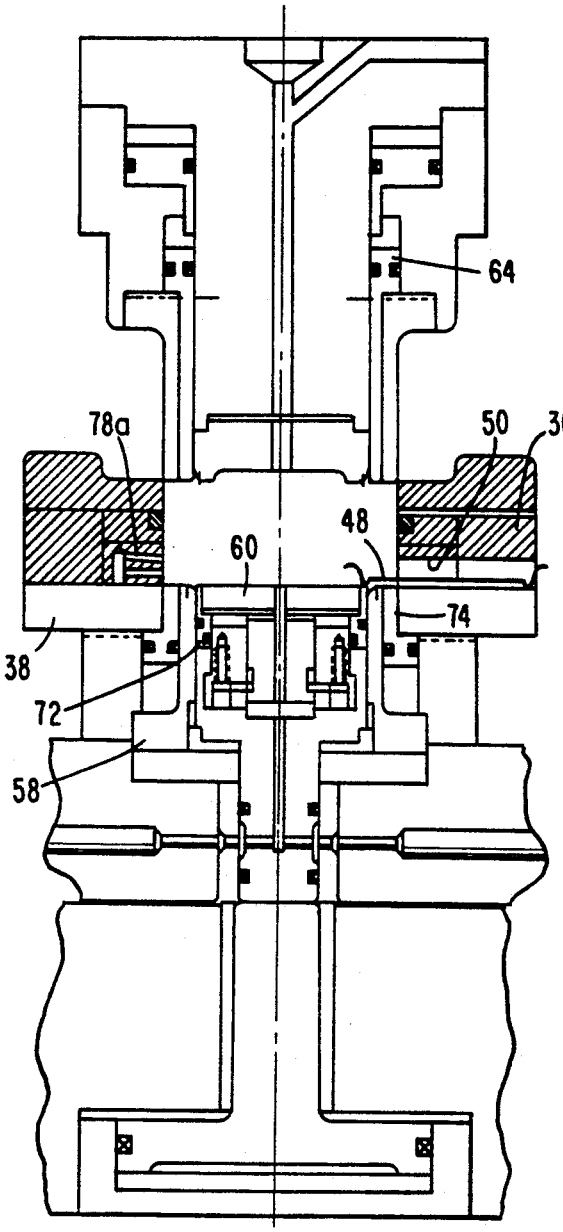

In FIG. 5H, the ram is at 236° on the upstroke. Lift ring 72 raises the end to the level of the ejection slot 50 with the die core 60. The air blast from the lower blow-off port 78*b* hits the end 48 before it is released by the tooling. After the punch 54 has separated, the vacuum supplied through the lower tooling to the end underside is terminated. At the instant the tooling releases the end 48, the end starts to move towards the eject opening of the ejection slot 50 (FIG. 5I). The air blast from the top port 78*a* is directed downward to help prevent the end 48 from tipping up as a result of the air flow through the lower orifice 78*b* beneath the seaming panel tipping up as it passes over the gaps between the tooling components. Smooth high speed exit is further achieved due to the final positioning of the top surface of the die core 60 and the upper end of the lift ring 72 co-elevational with the lower draw ring 74 and die center 58. These bottom die tool elements provide an exit channel to the ejection slot 50 to enable rapid, smooth high-speed ejection of the formed can end from the discharge slot now defined by the upper and lower tooling elements (i.e., the upper end of the discharge slot being defined by the bottom edge of the upper draw ring 64 engaging the top edge surface of the formed can end neck).

Figure 5J:
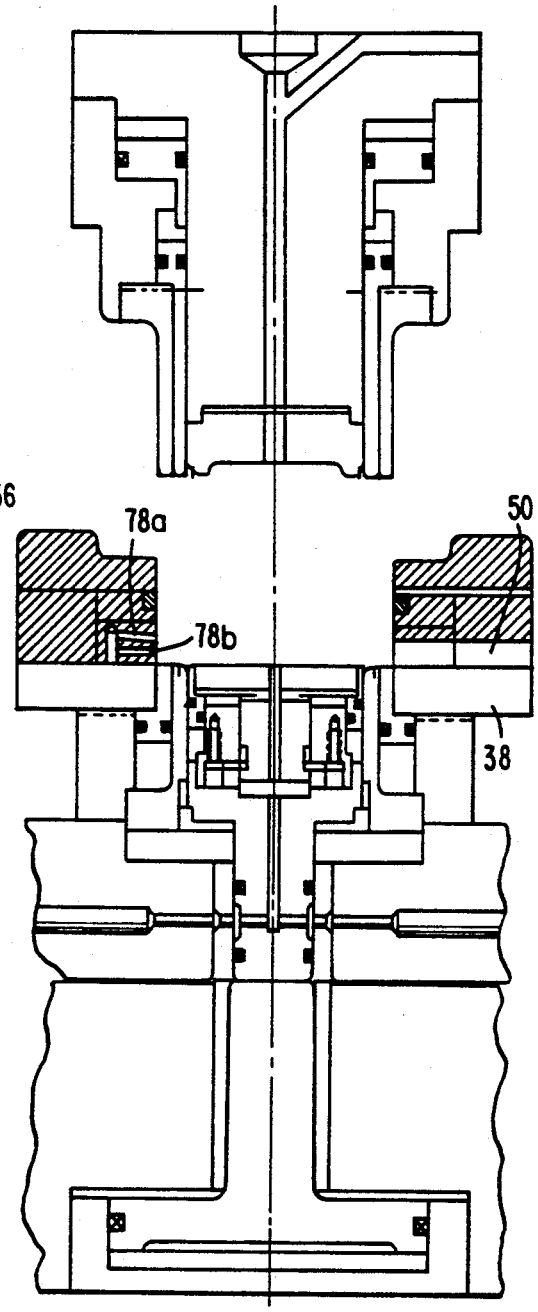

In FIG. 5J, the ram is at 285° on the upstroke. The end 48 has been ejected and the stock 30 is ready to advance for the next blank to repeat the forming cycle.

Lower Die Assembly

Figure 7:
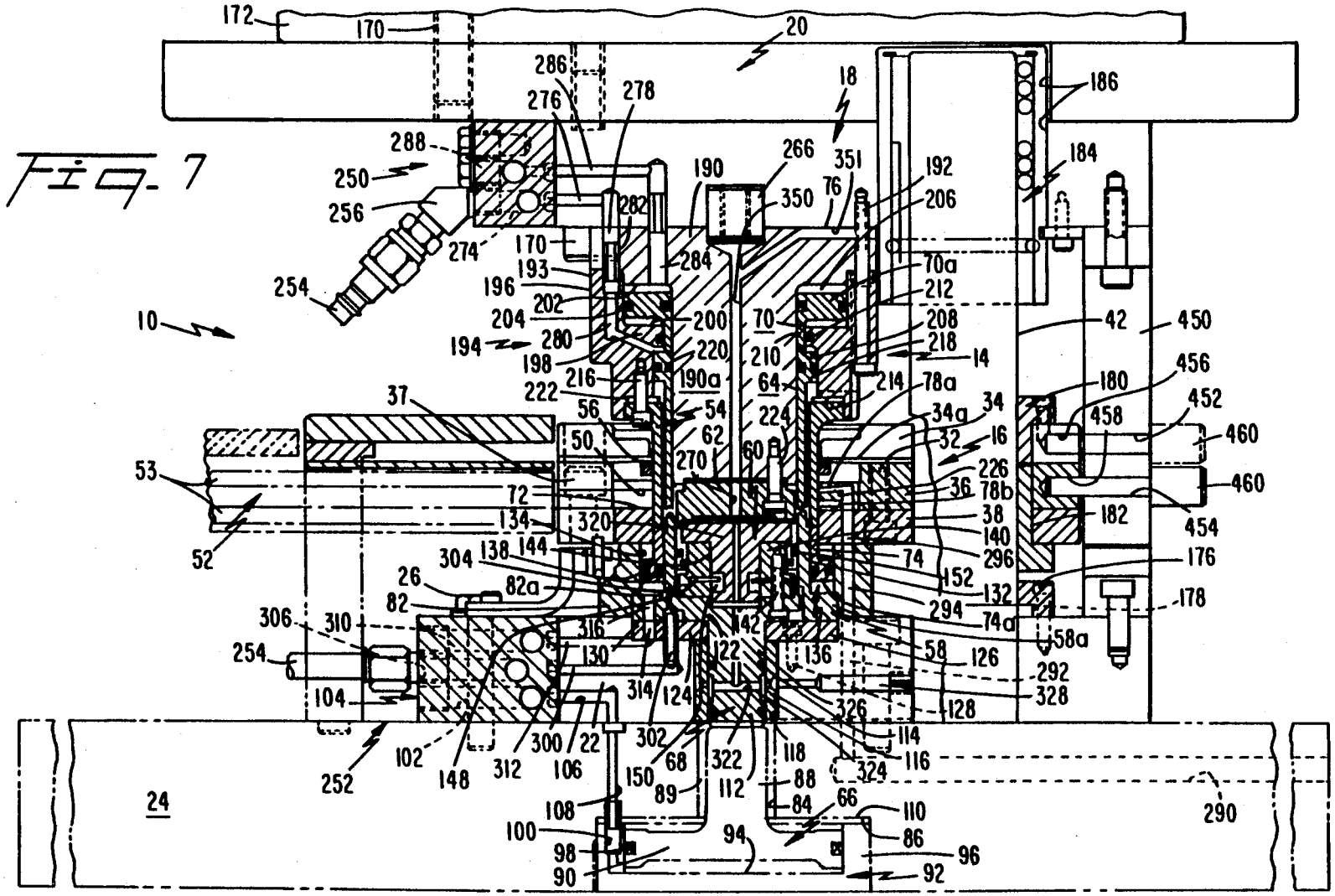
FIG. 7 is a detailed cross-sectional view of an upper and lower die assembly of this invention.

With reference now to FIG. 7, each lower die assembly 16 is mounted to the bolster plate 24 (adapted to be bolted to the press bed 80, FIG. 1) through die shoe 22 secured to the top surface thereof with screws 26, and a die holder ring 82. The bolster plate 24 is formed with a vertically extending cylindrical bore 84 opening to the top surface of the bolster and extending downwardly through the thickness of the plate to intersect a large diameter cylindrical recess 86 formed in the bottom surface of the plate. During assembly, this recess 86 is adapted to receive the reforming piston 66. The piston 66 has an elongate cylindrical section 88 (cylinder) slidably disposed within a bushing 89 (preferably made of self-lubricating, non-metallic material to avoid seizing) mounted in the cylindrical bore 84 and projecting upward from a larger diameter, disc-shaped cylindrical section (piston) 90 received within the large diameter recess 86. This piston section 90 is captivated for reciprocal movement within a piston housing defined by the recess bottom and a retaining end cap 92 fitted within the recess 86. The lower end of the piston housing is defined by an interior surface of an end wall 94 of the end cap 92 which is suitably spaced from the recess bottom through an annular mounting flange 96 projecting upwards from the end wall to contact the recess bottom. The outer annular surface of the flange 96 contacts the cylindrical side wall of the recess 86 and the inner cylindrical surface of the flange defines the lateral extent of the piston housing. The peripheral surface of the piston 90 is in sliding sealing contact with this cylindrical surface through a seal 98 mounted in an annular groove formed in the peripheral surface.

To raise the die core 60 (i.e., to a predetermined height (0.128") in the center panel forming sequence depicted in FIGS. 5E and 5F, by the action of the reform piston 66, pressurized air is supplied to the lower end face of the piston section 90 through an air passageway 100 formed in the mounting flange 96, which is in communication with an air passageway 102 in a bottom air manifold 104 (attached to the die shoe 22) through connecting passageways 106 and 108, respectively, extending through the bolster plate. The top surface of the piston section 90 thereby normally contacts the recess bottom (through a flat spacer 110 disposed therebetween), under the action of continuous pressurized air, and is actuated and displaced vertically by the pilot die core 112 in FIG. 5E whereupon the piston section 90 descends approximately 0.128" into retaining cap 92.

The pilot die core 112 extends upwardly through the bottom die shoe 22 from bottom surface contact with the upper end of the coaxially aligned re-form piston 66. More specifically, the pilot die core 112 includes an elongate lower cylindrical section 114 received in a pilot bushing 116 mounted within a vertical bore 118 in the bottom die shoe 22. This vertical bore 118 is in coaxial alignment and communicates with the smaller diameter vertical bore 84 in the bolster plate 24 containing the working end 88 of the reform piston 66. The resulting difference in diameter defines an annular lip 120 at the interface between the bolster plate 24 and bottom die shoe 22 which supports the bottom surface of the bushing 116.

The upper portion 122 of the pilot die core 112 is of larger diameter than the elongate lower section 114 and includes an annular bottom surface 124 engaging the top surface of a spacer 126 defining the bottom stroke of the die core 60. This spacer 126 is mounted with screws 128 in a cylindrical recess formed in the top surface of the die shoe 22 in coaxial alignment with the pilot bushing 116. The thickness of the spacer 126 is less than the depth of the recess, thereby defining a seat with the exposed upper cylindrical edge of the recess side wall 130. This seat snugly receives the enlarged diameter bottom section 58*a* of the stationary die center 58 which rests on and is supported by the top surface of the spacer 126. The die center 58 is securely retained within the seat by means of the cylindrical die holder ring 82 having an interior stepped cylindrical surface 82*a* engaging the upper periphery of the die center enlarged diameter bottom section 58*a* in clamping contact.

The cylindrical die center 58 projects upwardly from its enlarged diameter bottom section 58*a* and includes an outer annular vertical surface 132 which is radially inwardly spaced from the inner cylindrical vertical surface 134 of the die holder ring 82 projecting upwardly from the stepped surface 82*a*. These parallel surfaces 132,134, together with an upward facing surface of the die center enlarged diameter bottom section 58*a* extending therebetween and a portion of the bottom surface of the cut edge support plate 38 (resting on and supported by the top surface of the die holder ring 82), define a cavity 136 (lower draw ring pneumatic air cushion) receiving an enlarged diameter bottom (piston) section 74*a* of the lower draw ring 74. This cylindrical bottom section 74*a* is in sliding sealing contact with the cavity side walls 132,134 via seal rings 138 respectively mounted in annular grooves formed in the bottom section. The cut edge support plate 38 terminates radially outwardly from the upper end of the die center 58 to define an annular slot therebetween adapted to receive the upper forming end of the lower draw ring 74 and the punch shell 54 in the end forming process described above.

The movable bottom die core 60 is reciprocatingly mounted to the upper end of pilot die core 112 through a pilot ring die 140. This ring die 140 is bolted to the upper surface of the pilot die core 112 with a cap screw, as at 142, and includes a central bore 144 extending longitudinally entirely through the ring die. This bore 144 slidingly receives an elongate cylindrical lower section 60*a* of the movable bottom die core 60. A cylindrical recess centrally formed in the upper surface of the pilot die core 112 (radially inwardly from the pilot ring die 140), in alignment with bore 144, receives the bottom end 60*a* of the movable die core 60 in its bottom stroke position (depicted in FIG. 7).

The upper surface of the pilot die core 112 is circumscribed by a thin peripheral cylindrical mounting flange 146 defining a seat with the upper surface which receives the lower end of the pilot ring die 140. The lower elongate section 60*a* of the movable bottom die core 60 is captivated for sliding movement within the vertical bore 144 of the pilot ring die 140 by means of a split washer 148 (FIG. 5A) extending radially inwardly from the bore side walls into an annular slot 150 formed in the outer surface of a bottom portion of the elongate section 60*a*. This annular slot 150 includes top and bottom end walls engagable with the washer 148 to limit sliding movement of the bottom die core 60 relative to the pilot ring die 140.

Each lower die assembly 16 is completed with the lift ring 72 having an upper lifting end 72*a* disposed between the upper forming end of the die center 58 and the enlarged diameter upper forming end of the movable die core 60. An enlarged diameter bottom portion 72*b* of the lift ring 72 is disposed between the upper end of the pilot ring die 140 and an intermediate portion of the die center 58 in sliding sealing contact with side walls thereof through inner and outer seals 152. This enlarged diameter portion 72*b* is captivated by the periphery of the bottom surface of the die core upper forming end, limiting relative upward movement of the lift ring. The seals 152 define a lift ring pneumatic air cushion as described hereinbelow.

As a result of extensive experimentation, it was discovered that the annular heel 156 (see FIG. 5A) of section 60*a*, formed below the annular slot 150 to define the bottom end wall thereof (engageable with the washer 148) had a tendency to break at high speeds of operation, requiring replacement of the die core 60 with resulting down time. In accordance with an alternative preferred embodiment of the invention, FIG. 10 therefore, the pilot die core 112 and pilot ring die 140 are preferably formed as unitary die core 157 of one piece construction. The annular slot 150 of section 60*a* is replaced with a through bore 158 having top and bottom end walls 160 and 162 spaced from each other by a distance equal to the spacing of the corresponding top and bottom annular slot walls in the FIG. 7 embodiment. A dowel pin 164 having opposite ends mounted in coaxially aligned through bores formed in the unitary die core 157 (at a location corresponding to the positioning of the split washer 148 in the pilot ring die 140 of FIG. 7) extends through the bore 158 of the die core 60 to limit the upper and lower extent of reciprocating die core movement in a manner identical to that disclosed in FIG. 7.

Upper Die Assemblies

Each upper die assembly 14 is mounted to punch shoe 18 (bolted to the adapter plate 20 at 170) which is in turn bolted to the press ram 172 as at 174. The upper and lower die assemblies 14,16 are perfectly aligned with each other for high-speed operation through a series of guide posts 42 (only one depicted in FIG. 7) each secured to the upper surface of the die shoe 22 with a clamp ring 176 and holddown bolts 178. The guide posts 42 project upwardly from the die shoe 22 through upper and lower bushings 180 and 182 respectively mounted in aligned vertical through bores formed in the stripper plate 34 and cut edge holder plate 36. The upper end of each post 42 is slidably received in a ball bushing 184 mounted within suitable aligned openings 186 formed in the punch shoe 18 and adapter plate 20 adjacent the upper die. The ball bushing 184 projects downwardly from the punch shoe 18 for a sufficient distance to enable the upper post ends to remain captivated within the bushings when the upper die returns to top dead center (TDC). The bottom dead center position of the upper die 14 is depicted in FIG. 7.

Each upper die assembly 14 is mounted to the punch shoe 18 with punch holder 76 having an enlarged diameter base section 190 bolted to the shoe as at 192. The enlarged diameter mounting base section 190 is formed with a step 193 against which is seated an adapter-punch shell 194 also having an enlarged diameter base section 196 through which bolts 192 extend. The adapter-punch shell 194 includes a second cylindrical portion 198 of smaller diameter than the base cylindrical mounting portion 196 which defines an upward facing annular surface 200 spaced downwardly from a bottom surface 202 of the mounting base 190 of the punch holder 76. This surface 202 extends radially inwardly towards an elongate cylindrical section 190*a* of the punch holder 76 projecting downwardly from the enlarged diameter base section 190 thereof. These surfaces 200,202, in conjunction with an interior vertical cylindrical surface 204 of the adapter-punch shell enlarged diameter portion 196, and the exterior surface of the elongate section 190*a* of the punch holder 76, define a cavity 206 (secondary draw ring pneumatic air cushion) adapted to contain the enlarged diameter portion 70*a* of secondary draw ring 70 having inner and outer surfaces in sliding sealing contact with the aforesaid vertical surfaces of the punch holder and adapter-punch shell.

The second cylindrical portion 198 of the adapter-punch shell 194 is formed with a vertically extending interior surface 208 spaced radially outward from the outer surface of the punch holder elongate section 190*a* to receive a cylindrical portion 210 of the secondary draw ring 70 projecting downwardly from the enlarged diameter upper portion 70*a* thereof. A seal 212 disposed in a cylindrical groove formed in the surface 208 of the adapter-punch shell second portion 198 provides sliding sealing contact with the outer periphery of the secondary draw ring.

The bottommost cylindrical portion of the adapter-punch shell 194 is formed with a cylindrical recess 214 to which is mounted an enlarged diameter base section of the punch shell 54 with screws 216. The punch shell 54 projects downwardly from the adapter-punch shell 194 in coaxial alignment with the punch holder 76. The inner cylindrical surface of the punch shell 54 is spaced from the outer annular surface of the punch holder elongate section 190*a* to define an annular passage through which the upper draw ring 64 extends between the punch shell and punch holder in operative alignment with the lower die center 58. The upper end of the lower draw ring 64 is formed with an enlarged diameter portion 218 slidingly and reciprocatingly mounted between the punch holder 76 and inner cylindrical surface of the adapter-punch shell 194 extending upwardly from the punch shell 54 mounting base section. Seals 220 are provided in inner and outer grooves formed in the enlarged diameter section 218 of the draw ring to provide sealing contact with the punch holder and adapter-punch shell, as aforesaid, and define a lower draw ring pneumatic cushion.

The cylindrical recess 214 formed in the downwardly projecting portion of the adapter-punch shell 194 may receive shim material 222 to re-establish relative set-up after sharpening punch shell 54.

The punch core 62 is secured with bolt 224 to project downwardly from punch holder 76 in operative alignment with die core 60.

Disposed between the cut edge 56 and the cut edge support plate 38 is a spacer 226 having generally horizontally extending blow-off air passageways 78*a*,78*b* whose function is described more fully below. These passageways 78*a*,78*b* are located on one side of the forming cavity, coelevational with ejection slot 50 (see FIG. 5J) formed between the bottom surface of a radially inwardly extending portion of the cut edge holder plate 36 (supporting the cut edge in cooperation with the spacer) and a top surface of the cut edge support plate 38 extending immediately radially outwardly adjacent the travel path of the punch shell 54. As depicted in FIGS. 5I and 5J, the bottom surface of this ejection slot 50 is preferably substantially coplanar with the top surface of the die core 60 as well as the top surfaces of the lower draw ring 74, die center 58 and lift ring 72 when the ram is on the upstroke (FIG. 5H). The periphery or seaming panel of the can end is engaged from above by the bottom forming surfaces of the upper draw ring 64 engaging or slightly spaced from the top surfaces of the seaming panel to define the upper extent of the discharge slot between the upper and lower dies 14,16. This upper extent is essentially coplanar with a machined downward facing surface of the cut edge spacer 226 and cut edge holder plate 36 defining the uppermost extent of the ejection slot 50. Thereby, at the instant the upper die tooling 14 releases the end, the formed end instantaneously starts to move toward the opening of the ejection slot 50. The air blast from the top port 78*a* is directed downward to help prevent the end from tipping up, as aforesaid.

The ejection slot 50 further comprises an ejection chute 52 forming a continuous exit path in alignment with the slot. Although not shown in detail, the chute 52 may be formed from U-shaped channel stock containing upper and lower support members mounted therein with spacer rods 53. This chute 52 enables high-speed transfer of the formed ends to a curler (not shown) which may be of conventional construction.

The cut edge holder plates 36 with the stripper 34 are bolted at 37 to the die shoe 22, as described supra, and may be accurately located thereon by two leader pins (not shown in detail). These two plates 34,36 (including support 38) can be removed (lifted) from the tooling using press power, as described more fully below, to gain access to the lower die tooling in case of a jam or to remove parts for repair.

Pneumatic Air Systems

The end making machine 10 of the present invention utilizes compressed air to perform a variety of important functions in the manufacture of end shells. The pneumatic system includes pressurized air and vacuum circuits, described below with reference to FIG. 9, which hold the blank in place during forming, cushions the dies during the forming stroke, prevent the end from sticking to the punch after forming, and for ejecting the finished end from the press (described supra). Each circuit requires a specific pressure setting.

Generally speaking, the pneumatic system is designed to operate from any compressed air supply M of 100 psi or more. The main air supply M to the press is provided through a manual shutoff valve, pressure gauge, pressure switch S, and a three-way solenoid valve 600. The pressure switch S is normally set at 90 psi (adjustable). At start-up, the press controls will not be energized until this pressure switch S detects adequate air pressure for safe operation. The press is also equipped with a vacuum circuit which is used to hold the formed end in place until the die is ready to eject it. In the description following, reference is made to FIGS. 7 and 9 (air circuit diagram).

The compressed air is fed into the various circuits through top and bottom air manifolds 250 and 252 bolted to the punch shoe 18 and die shoe 22, respectively, into which are drilled air passageways for routing the air to the various die components. Rubber air lines 254 with quick disconnects 256 at the manifolds 250,252 carry the compressed air to each die station in each circuit at an appropriate pressure regulated by individual precision pressure regulators. For simplification, only one such air line and disconnect to each manifold is depicted in FIG. 7.

Circuit B, upper draw ring 64, and circuit C, secondary draw ring 70, work together to control the metal draw clamping force exerted on the seaming panel by the upper draw ring. The upper draw ring pressure is set at 72 psi and the secondary draw ring pressure is set at 133 psi. The upper draw ring circuit B supplies pressurized air to the annular pneumatic air cushion cavity formed between the top surface of the enlarged diameter section 210 of the upper draw ring 64 and the step section 208 of the adapter-punch shell 194 through an air passageway 274 in the top manifold which communicates with an L-shaped passageway 276 in the punch shoe 18. This passageway 276 in turn communicates with the pneumatic cushion through a series of connecting passageways 278 and 280 in the punch holder 76 and adapter-punch shell 194, respectively. Hollow roll pins such as 282 are provided within the respective air passageways at the interface between the adapter-punch shell 194, punch holder 76, and punch shoe 18.

Pressurized air is supplied to the pneumatic cushion formed between the enlarged diameter section **70*a* of the secondary draw ring 70 and the enlarged diameter section 170 of the punch holder 76 through a longitudinal passageway 284 extending through the punch holder enlarged diameter section in communication with an L-shaped passageway 286 in the punch shoe which receives air from a passageway 288 in the top manifold. In each circuit B and C, one regulator (not shown) controls the air supplied to all four die stations. The manifold 250** distributes the air to the individual pneumatic cushions in each of the four stations.

The blow off air (not shown in FIG. 9) is supplied at a pressure of about 45 psi to the blow off air passageways **78*a*,78*b* in the spacer 226 to blow the finished end shell out of the die forming area and into the ejection slot 50 for delivery to the curler. The blow off air is carried through tubing (not shown) to a blow off connection on the bolster plate 24 where a series of drilled air passageways 290 (one shown in FIG. 7) routes the air through the bolster plate to each of the four die stations. The air passageways 290 in the bolster plate 24 communicate with the blow off passageways 78*a*,78*b* through coaxially aligned longitudinal air passageways 290, 292 and 294 formed in the die shoe 22, die holder ring 82, and cut edge support plate 38, respectively. During normal operation, the blow off air is preferably supplied continuously to the blow off air passageways 78*a*,78*b* and the flow of air into the end forming cavity is normally blocked by the punch shell 54 until the punch shell clears the passageways 78*a*,78*b*** in its upstroke as depicted in FIG. 5H.

Circuit E controls the operation of the lift ring 72 wherein air pressure set at 15 psi is supplied through a precision pressure regulator (not shown in detail) set at 15 psi. Because of the lower pressure point, this circuit does not require a surge tank as do all the other pressurized air circuits. More specifically, pressurized air is supplied to a pneumatic cushion located beneath the lift ring 72 through a series of connecting passageways 300, 302 and 304 respectively formed in the die shoe 22, spacer 126 and die center 58, connected to a supply passageway 300 in the bottom air manifold 252 (bolted at 26 to the bolster plate at the rear of the machine).

After the forming stroke, as the die begins its upstroke, the air pressure raises the lift ring 72, which lifts the die core 60 and finished end to the level of the ejection slot 50 (FIG. 5H).

Circuit F controls the operation of the re-form piston 66, as described supra. Its regulator is set at 100 psi which provides the predetermined force needed to reform by allowing the die core 60 to move downward and upward by a predetermined amount to complete the forming of the end shell (see FIGS. 5D–5H). Air is supplied to the pneumatic cushion at the underside of the re-form piston 66 through the bottom air manifold 252. The manifold includes passageway 102 which communicates with the piston underside through L-shaped connecting passageway 106 in the die shoe 22, a longitudinal passageway 108 extending downwardly in the bolster plate 24, and a passageway 100 in the end cap 92.

Circuit G controls the operation of the lower draw ring 74. Its regulator is set at 51 psi. The air pressure supplied to the pneumatic cushion located at the underside of the draw ring 74 (between the die holder ring 82 and die center 58) controls the drawing force exerted on the end stock as the blank is being formed (see FIGS. 5C and 5D). The pressurized air is supplied through an air passageway 310 in the bottom manifold 252 which communicates with the pneumatic cushion through a series of passageways 312, 314 and 316 formed in the die shoe 22, spacer 126 and die center 58, respectively.

As in the case of the top manifold, air supplied to the lower circuits E, F and G is provided to the lower manifold 252 through tubing. In each circuit, one regulator controls the flow of air to the respective pneumatic cushions in all four die stations. The bottom manifold 252 distributes the air to the individual stations through appropriate passageways 102, 306 and 310.

The main supply solenoid valve 600 supplies pressurized air from the main supply line M through each of the inlet solenoid valves 400 (i.e., through $P_1$) during normal press operation. Prior to entering the die service mode, discussed infra, and prior to lubricating the pneumatic cushions, also discussed infra, the main supply solenoid 600 is switched to port to atmosphere and thereby vent and depressurize the cushions.

FIGS. 3 and 7 depict a vacuum circuit providing a positive vacuum of 8–10" Hg to the upper surface of the die core 60 to prevent the finished end from being drawn back up against the punch core 62 when it is released. The vacuum is applied to the underside of the end through a longitudinal vacuum passageway 320 extending through the die core 60. It holds the end against the die core 60 momentarily during the upstroke until the punch center 62 has withdrawn far enough that it no longer exerts a natural vacuum on the end. The vacuum is then released, and the blow off air ejects the end in preparation for the next press stroke.

More specifically, vacuum is supplied to the die core passageway 320 through a longitudinal vacuum passageway 320 formed through the pilot die core. This pilot die core vacuum passage 320 terminates in a transversely extending through bore 322 formed in a bottom portion of the elongate cylindrical section 112 of the pilot die core. This through bore 322 in turn communicates, at opposite ends thereof, with an annular passageway 324 formed in the elongate cylindrical section 114 between upper and lower seals 326 in sliding sealing contact with the inner cylindrical surface of the pilot die core bushing 116. The outer surface of the pilot die core bushing is formed with an annular vacuum passageway communicating with a vacuum passageway 328 in the die shoe 22. Vacuum is supplied to these various passageways through die shoe vacuum passage 328 which communicates with a rotary vacuum manifold valve 330 (FIG. 3 only).

With reference to FIG. 3, the rotary vacuum manifold valve 330 is schematically depicted as a cam operated valve having a cam arm 332 formed with a cam follower 334 at its distal end. The follower 334 is received in a cam slot 336 formed in a reciprocating guide bar 338 having an upper end attached directly to the punch shoe 18. The cam arm 332 is attached at its opposite end to a pivoting valve tube 340 extending through a series of generally identical vacuum manifold blocks 342 supplying vacuum to each of the tour die stations from a common vacuum source 344. As the punch begins its upstroke, the guide bar 338 attached to the punch shoe 18 moves up, causing the cam follower 334 to slide through the cam slot 336 following the profile thereof. In this manner, the cam follower rotates the cam arm 332 to thereby rotate the valve tube 340 so that the vacuum supply slots (not shown) within the manifolds 342 align with the vacuum passageways 328 formed in the die shoe 22 supplying vacuum to the centers of each of the die cores 60. As the punch continues upward, the vacuum supply slots rotate toward alignment with four vent orifices which open a path from the die cores 60 to atmosphere, thereby instantaneously releasing the vacuum.

Figure 10:
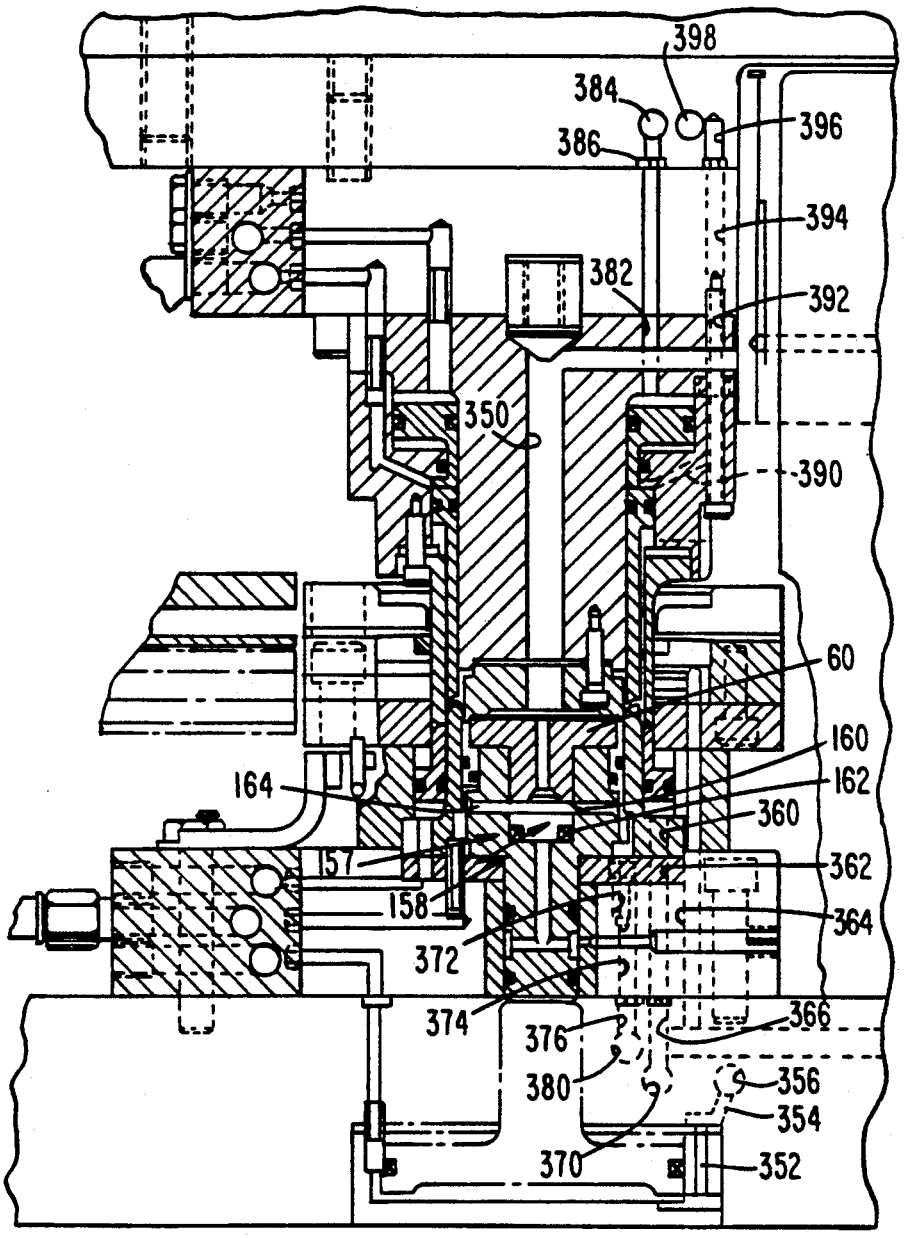
FIG. 10 is a second embodiment of the invention.

In accordance with a further unique feature of this invention, therefore, it has been discovered that high-speed operation (e.g., 650–660 strokes per minute) can be achieved by eliminating the use of blow down air and replacing blow down air passageways (not shown) with a passageway 350 communicating with atmosphere. Specifically, there can now be provided coaxially aligned passageways 350 in the punch center and punch holder, respectively, in which the longitudinally extending passageway in the punch holder intersects a transversely extending passageway 351 therein communicating directly with atmosphere as depicted in FIGS. 7 and 10.

Vacuum is totally relied upon to maintain positive contact between the end and bottom forming members both during the forming process and until the upper forming members clear the top edge of the formed can end. More specifically, the vacuum is released approximately 0.025 inches before the bottom die core 60 has ascended to its upper position (i.e., defining the bottom surface of the eject line between the dies). Since atmospheric air replenishes vacuum at approximately the speed of sound, the pressure at the underside of the formed end quickly approaches atmospheric pressure which corresponds with the atmospheric pressure conditions prevailing at the top side of the end through the atmospheric passageway. In this manner, there are no residual upward or downward forces acting on the can end at the eject line, thereby advantageously enabling the blow off air to quickly eject the end from between the forming members.

Lubrication of the Pneumatic Cushion Seals

Proper lubrication of the pneumatic cushion seals of each upper and lower die assembly 14,16 is essential to maintain reliability of the equipment. In the embodiment depicted in FIG. 7, each of the air seals are hand-lubricated with grease at regular intervals (e.g., weekly). With this arrangement, however, a number of problems have occurred, resulting in premature seal deterioration. One problem is that since each of the pneumatic cushions communicate with a source of pressurized air through a single passageway, Air trapped in the stagnant cushion produces water vapor which congeals the oil or grease lubricant. Since the grease is manually applied, there is also the possibility of human error in failing to provide adequate grease to all seals. In the event excessive grease is applied, there is the problem of oil accumulating at the seals which may actually coat the can ends during the forming process.

To avoid these problems, there is provided in the alternate preferred embodiment of the present invention an automatic air seal lubrication system, which automatically provides measured amounts of oil mist to each of the pneumatic cushions in the punch and die assemblies 14,16. More specifically, as will be seen below, the automatic lubrication system provides lubricated air to the upper draw ring circuit B, the re-form ring circuit C (i.e., secondary draw ring), the lift ring (shedder) circuit E, re-form cushion circuit F, and lower draw ring circuit G. The seals 326 on the die core are not serviced by the automatic lubrication system because doing so would directly expose the end shells to the lubricant. These seals 326 are preferably lubricated manually each time the dies are open for maintenance. The seals supplied with lubricated air from the automatic system are preferably lubricated each time the coil of feedstock is changed (i.e., approximately three times per shift).

Figure 9:
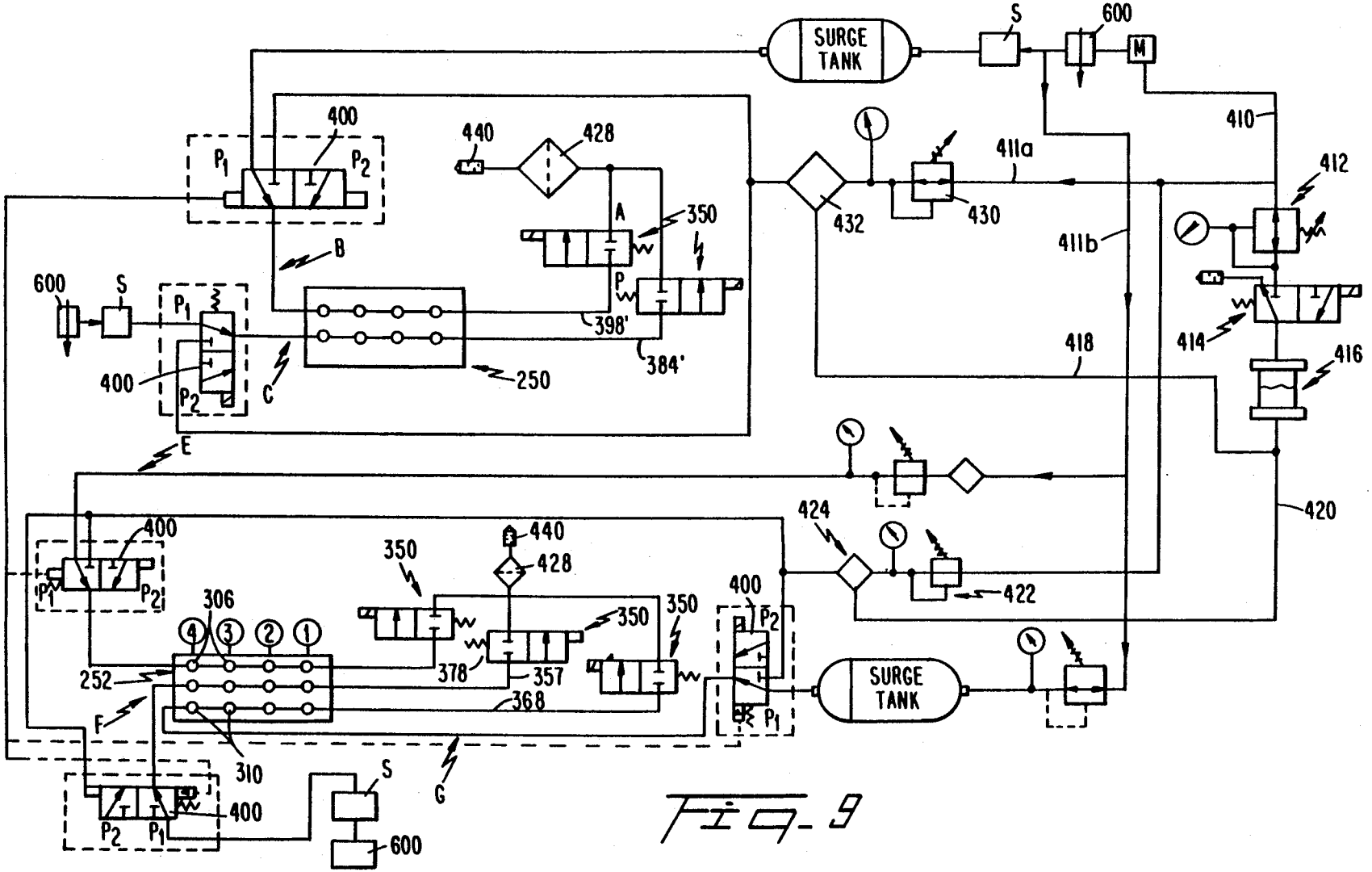
FIG. 9 is a circuit diagram depicting the flow of pressurized air into and out of the upper and lower die assemblies during both normal operation and in lubrication maintenance cycles.

Referring to FIG. 10, each of the foregoing circuits supplied with lubricated air from the automatic system is now provided with discharge air passageways which are normally closed by individual air exit solenoids, generally designated with reference numeral 350 in FIG. 9, during end forming operations. When the end making system is placed in die service mode (e.g., during a change of feed coil), described infra, the solenoid 600 is first actuated to port the pneumatic cushions to atmosphere and thereby safely depressurize the pneumatic cushions prior to changing the coils. As will be described more fully below, solenoids 400 are then shifted to communicate with the lubrication circuit and solenoids 350 are opened to allow for subsequent venting of the pneumatic cushions to dispel stagnant air and for continuous circulation of lubricated air through the cushions during the lubrication process.

In the alternate preferred embodiment, FIG. 10, the air circuit F to the re-form piston 66 is now formed with a discharge passageway comprising an L-shaped passage 354 formed in the bolster plate 24, in communication with a connecting air discharge passageway 356 formed in the bolster plate 24. This connecting passageway 354 in turn communicates with solenoid exit air valve 350 through a quick disconnect tubing 357 (FIG. 9) attached to the discharge port 356 formed in the bolster plate 24.

The lower draw ring pneumatic cushion (circuit G) is also formed with a series of coaxially aligned discharge air passageways 360, 362, 364 and 366 respectively formed in the die center 58, spacer 126, die shoe 22 and bolster plate 24 to vent pressurized air within this pneumatic cushion to a separate solenoid 350 through additional tubing 368 connected to the lower draw ring discharge port 370 in the bolster plate. Likewise, the pneumatic cushion for the lift ring (circuit E) is now formed with a series of discharge air passageways 372, 374 and 376 in the spacer 126, die shoe 22 and bolster plate 24 for connection to a different solenoid 350 through separate tubing 378 attached to a lift ring discharge port 380 in the bolster plate.

The upper secondary draw ring (circuit C) pneumatic cushion is formed with a discharge air passageway 382 extending through the punch holder 76 and punch shoe 18 for communication with a discharge port 384 in the adapter plate 20 through a connecting passageway 386. The upper draw ring pneumatic cushion (circuit B) is also formed with a series of discharge passageways 390, 392, 394 and 396 respectively in the adapter-punch shell 198, punch holder 76, punch shoe 18 and adapter plate 20 communicating with its own discharge port 398 therein. Separate tubings 384',398' connect these discharge ports 384,398 to separate solenoids 350 for controlled venting of pressurized air in the cushions.

When it is desired to lubricate the pneumatic cushions with the automatic air seal lubrication system of the invention, normal operation is terminated and the press is placed in the die service mode as discussed below. The pneumatic cushions are depressurized through the inlet solenoids 400 (still in operational position $P_1$) by switching main supply solenoid 600 to communicate with atmosphere and halt the flow of incoming pressurized air. The inlet solenoids 400 are then switched to position $P_2$ which communicates the air circuits with the lubricated air supply circuits discussed more fully below. When inlet solenoids 400 are switched to position $P_2$, outlet solenoids 350 are then opened and maintained in the open position. Further, when valves 400 are in position $P_2$ to supply oil mist to the pneumatic air cushions through mist lubricators 424 and 432 (which are provided with mechanical float switches to ensure full supply of oil in the misters from reservoir 416 as described below), then valve 414 is opened to supply pressurized air to reservoir 416 to push oil from 416 through lines 418 and 420 to supply oil to the lubricators.

After a predetermined time interval, the computer control for the press will shut off inlet valves 400 from their oil lubrication position $P_2$ and will re-open $P_1$. Motorized valve 414 is also shut off and exit solenoids 350 are closed. The system is now in position to repressurize the pneumatic air cushions with pressurized air supplied from main solenoid 600 for renewed end forming operations.

Air for the automatic lubrication system is then provided by a line 410 which taps into the main air supply M ahead of the motorized shut off valve 600 for the press. This line 410 feeds to a regulator 430 connected to mist lubricator 432. The regulator 430 regulates the pressure of lubricated air supplied from lubricator 432 to the upper circuits B and C through the three-way inlet solenoids 400 in their lubrication positions $P_2$. The lubricated air is supplied at a pressure of 75 pounds as regulated by pressure regulator 430.

While pressurized air is supplied to regulator 430, from line 410 through line 411*a*, the pressure regulator 422 is supplying pressurized air to the mist lubricator 424 from 410 through line 411*b*. This air is also supplied at a pressure of 75 pounds (regulated by 422) into the lubricator 424 where the oil is mixed with air and atomized. The lubricated air is then supplied into each of the three-way inlet solenoids 400 (in position $P_2$) which directs the lubricated air to the re-form cushion 66, lower draw ring 74 and lift ring 72 through the respective air inlet manifold passageway 102, 310 and 306. The lubricated air exits from the respective cushions in the upper and lower circuits through the associated discharge air passageways mentioned above and then through the air outlet solenoids 350 where the lubricated air is then passed through an oil filter 428 before being vented to atmosphere through muffler 440.

The regulator 412, normally closed two-way motorized valve 414 (which automatically opens when valves 400 are switched to lubrication position $P_2$ and is shut off together with exit solenoids 350 when valves 400 are switched back to position $P_1$), and oil reservoir 416 constitute an oil supply system which continuously replenishes the reservoir of oil in each of mist lubricators 424,432, through lines 420 and 418, respectively.

The automatic lubrication system of the alternate preferred embodiment is activated automatically by a computer controller which does not form a part of the present invention but whose logic is set forth hereinabove. The controller activates the lubrication system at each coil change. When the controller detects the end of the coil, the press is stopped, the pneumatic air cushions are depressurized, and the auto lube cycle begins in the manner described above so that pressure regulated lubricated air is supplied through the inlet valves 400 into the upper circuit pneumatic cushions (i.e., the secondary draw ring 70 and the upper draw ring 64) through the associated air inlet passageways 286 and 276 while pressure regulated lubricated air is simultaneously supplied to the lower circuit pneumatic cushions. The exit valves 350 are open, allowing the air to pass through and out of the pneumatic cushions after depositing lubricant. As mentioned above, before it is released to atmosphere, the lubricated air passes through the coalescing filters 428 where all remaining oil is collected, as aforesaid.

At the end of a predetermined time interval (e.g., three minutes) as aforesaid, the lubrication cycle is terminated. Inlet valves 400 are switched from $P_2$ to $P_1$ which causes exit solenoids 350 to close and motorized valves 414 to shut down. Thereby, the lubrication lines are closed and the press is now ready for operation.

The oil reservoir regulator 412 setting is preferably at least 20 psi greater than that of the lubricator regulators 422 and 430 or oil may back flow to the reservoir 416 during the lubrication cycle.

The automatic lubrication system of the present invention advantageously provides a unique means to ensure that each of the pneumatic seals receives a metered amount of lubricated air to ensure high-speed and reliable seal operation while preventing seal failure. During each coil change, approximately 8 drops per minute per pocket of oil are metered through the oil misters 424,432 (without injectors) to ensure that a fine mist of oil is provided to the seals for lubrication. Any remaining oil leaving the cushions through the exit lines is captured by the coalescing filters 428, thereby minimizing pollution. The feature of continuously venting the pneumatic cushions during the lubrication sequence also advantageously prevents stagnant air cushions from developing within the die assemblies 14,16 that otherwise disadvantageously results in cumulative oil in the system as well as water condensing in the oil.

Die Service Mode

The die service mode is used during all service or adjustment activities which require the use of press power. This mode permits the operator to use the press motor to move the ram in small increments. After setting the press into the die service mode such as from the manufacturing or "continuous service" mode (normal operation), the pneumatic air cushions are first vented through solenoids 400 (position $P_1$) by switching solenoid 600 to communicate with atmosphere. Next, the automatic lubrication system is initiated as described above. The main press motor is then started to enable the press operator to "inch" the press or to enable the press to run continuously.

The die service mode is also used when changing coils. In this mode, after depressurizing the pneumatic air cushions as discussed above, the ram is typically inched to its top dead center position so that it clears the feed slot 32 to enable a fresh supply of coil stock to be inserted between the die assemblies 14,16.

In accordance with another unique feature of this invention, press power can also be used in the die service mode to raise the cut edge plate 36 and/or the stock feed or stripper plate 34 to allow maintenance access to the lower die assemblies 16. To achieve this objective, a pair of homing blocks 450 (only one shown in FIG. 7) are respectively bolted to opposite ends of the punch shoe 18 and project downwardly towards the die shoe 22. The lower end of each homing block 450 is spaced a sufficient distance from the die shoe 22 so as to avoid contact therewith when the punch shoe 18 is at its bottom dead center position as depicted in FIG. 7. However, the lower end of each homing block 450 is formed with a pair of vertically spaced through bores 452 and 454 extending perpendicular to the die forming axis. In the bottom dead center position of the punch shoe 18, these through bores 452,454 are respectively aligned with a pair of blind bores formed in the ends of the stripper plate 34 and the cut edge support plate 38.

When it is desired to access the bottom die assemblies 16 such as for repair or replacement, it is necessary to lift the cut edge support plate 38 and stripper plate 34 to expose the lower dies. To accomplish this, the bolts 37 securing the cut edge support plate to the die shoes 22 are first removed and are preferably placed in holes formed in a safety box 500, which will be described infra. Next, a pair of lift pins 460 are removed from the safety box and are inserted through the bores 454 in the lower end of each homing block 450 to engage the blind bores 458 formed in the cut edge support plate. Press power is then applied to raise the punch shoe 18 which in turn raises the cut edge support plate 38 and the stripper plate 34 from the bottom die through the lift pins 460. In this manner, access to the bottom die assemblies 16 is easily attained using press power.

If it is desired to lift only the stripper plate 34 such as to gain access to the feed slot 32, the bolts 37 holding the cut edge holder plate 36 and the cut edge support plate 38 to the die shoe 22 are not removed. Instead, the bolts (not shown in detail) securing the stripper plate 34 to the cut edge holder plate 36 are removed and lift pins 460 are inserted into the upper hole 452 in the homing block 450 so as to engage the hole 456 in the stripper plate.

Figure 11B:
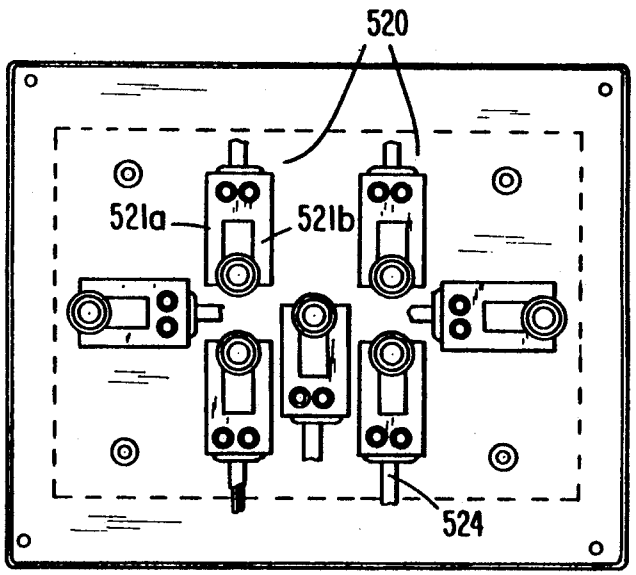
FIGS. 11A and 11B are partial sectional views depicting a safety box for preventing press operation and damage to the die assemblies during various types of service or repair.
Figure 11A:
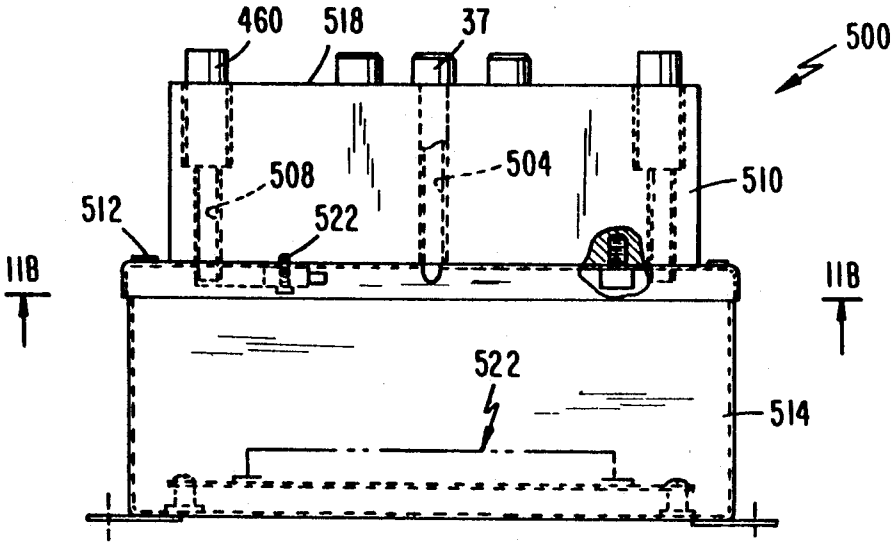
Figure 12B:
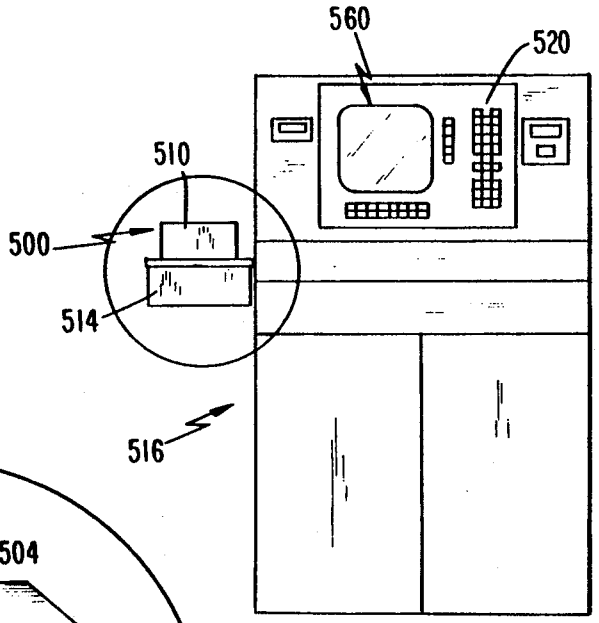
FIGS. 12A, 12B and 12C are partly perspective, partly schematic views of the safety box depicted in FIG. 11 as mounted to a programmable controller system.
Figure 12C:
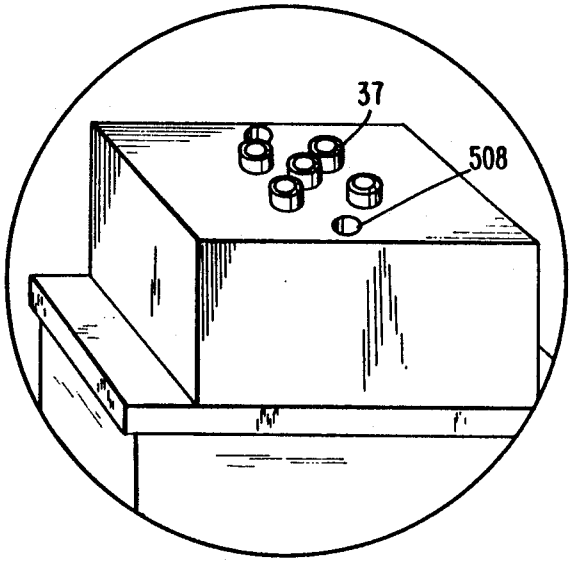
Figure 12A:
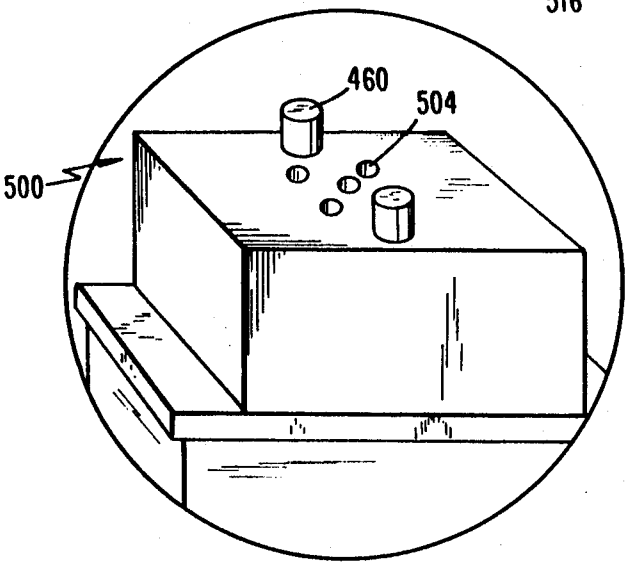

The present invention further features a safety box 500 depicted in FIGS. 11 and 12 which is interlocked with the press controls (schematically depicted at 502 in FIG. 12B) to prevent the machine operator from using press power to lift the stripper plate 34 or cut edge support plate 38 unless the die mounting bolts 37 are removed and placed within openings 504 of the safety box. The safety box 500 also prevents the press from being operated in the continuous mode of operation (or in a single stroke mode) unless the die mounting bolts 37 are removed from the box 500 and the two lifting pins 460 are placed in the box within holes 508 as depicted in FIGS. 11A and 12A.

More specifically, safety box 500 includes a receptacle box 510 (FIG. 11A) bolted at 512 to a base 514 which is in turn secured to a control console 516 schematically depicted in FIG. 12B. The top surface 518 of receptacle 510 is formed with the five bolt receiving openings 504 and the two lift pin receiving openings 508 (FIGS. 12A and 12C) enabling the bolts and pins to be inserted downwardly into the interior of receptacle 510 through the openings. With reference to FIG. 11B, there are provided a plurality of proximity sensors 520 bolted to the receptacle box 510 as at 522 (FIG. 11A). Each proximity sensor 520 (of conventional construction) is connected to a terminal board 522 within base 514 with leads 524. The terminal boards 522 are then wired into the logic control system (schematically depicted at 550 in FIG. 13). The proximity sensors 520 detect the presence or absence of metal (i.e., lift pins 460 or bolts 37 extending between sensor portions **521*a* and 521*b*) when the bolts or pins are appropriately positioned within the box as aforesaid. In proper position, the appropriate ones of sensors 520 input a signal through terminal board 522 to the logic control system 550 to prevent the operator from trying to use the press to lift the stripper plate or cut edge support plate unless the die mounting bolts are removed and placed in the safety box, or to prevent the press from being operated in the normal or continuous mode unless the die mounting bolts are removed from the box and the two lifting pins 460** are placed in the box.

The particular configuration of the terminal boards 522 and the manner in which they are wired into the logic control system 550 so as to enable use of safety box 500 in the manner described above will be obvious to one of ordinary skill in the art from a review of this disclosure and no further discussion herein is believed necessary.

Figure 13:
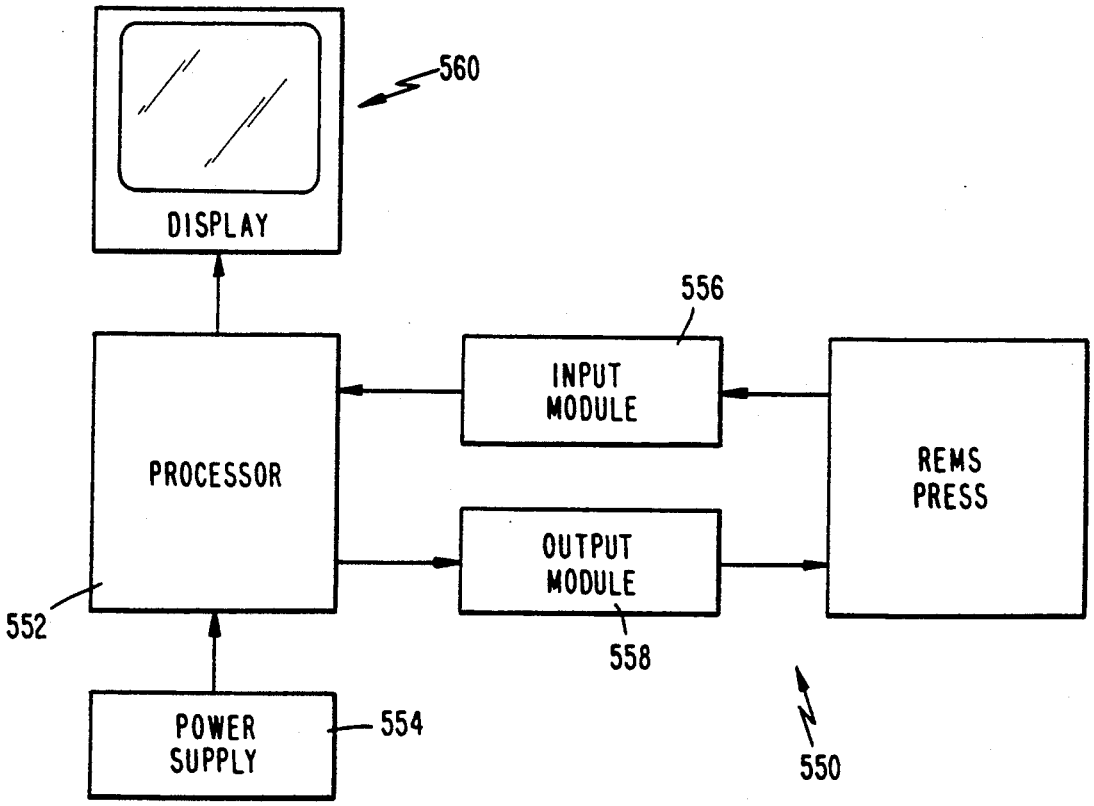
FIG. 13 is a float chart of a programmable logic control system for operating the end making system 10 of the invention.

The end making system 10 of the present invention is controlled by a programmable logic control (PLC) system 550 schematically depicted in FIG. 13 for all control and fault functions such as those described supra. One such control system which may be used in the present invention is an Allen-Bradley PLC-5/15 programmable controller. A conventional relay control system (not shown in detail) is used to control starting and stopping of the press, and for all equipment guard interlocking, so as to decrease the possibility of operator injury or equipment damage.

With reference to FIG. 13, the PLC system 550 comprises the following basic components: a programmable controller or processor 552; a power supply 554; input and output modules 556 and 558, respectively; and a CRT display unit 560 (also depicted in FIG. 12B).

The processor 552 contains a logic program stored in an electronically programmed read only memory (EEPROM) module which tells the processor how to operate the machine in accordance with the different operational modes (e.g., die service mode, automatic lubrication system, etc.) as discussed in detail above. The power supply 554 provides power for the processor 552 and also controls the system to allow for a controlled shut-down in the event of a power outage.

The input modules 556 accept data from various operating components of the machine and forward it to the processor 552. An example of an input would be a signal from a pressure switch (not shown in detail) indicating a low air pressure condition in a draw ring cylinder.

The output modules 558 receive commands from the processor 552 and send them out to electrical components in the end making machine 10. An example of an output would be a command to stop the press crank drive in response to the low air pressure input described supra.

The logic control system 550 and the relevant logic is set forth hereinabove in sufficient detail so as to enable one of ordinary skill in the art to program the processor 552 without undue experimentation. Safety box 500 and the manner in which the sensors 520 are wired into the input and output modules 556,558 will also be obvious to one of ordinary skill from a review of this disclosure.

In summary, the end making system 10 of the present invention enables high-speed forming of can ends to occur with minimum maintenance and down time. For example, the feature of forming the can ends and ejecting them through an ejection slot 50 below the feed line is one important factor contributing to the high-speed operation. By immobilizing the bottom core pad 60 at the level of the ejection slot 50, there is provided a smooth exit path enabling the formed end to the blown into the slot from between the dies without wobbling, since positive control over the formed end is maintained by the upper and lower die members immediately prior to blow-off.

The feature of utilizing pneumatic air cushions between the various die forming members eliminates the need for repair and replacement of spring members and provides faster response times during the forming operation.

The feature of maintaining positive vacuum seating contact of the blank with the bottom former 60, with or without blow down air, contributes to the high-speed forming operation by ensuring that the formed end is properly aligned with the ejection slot 50. As discussed above, the feature of solely utilizing vacuum, in combination with atmospheric pressure air acting on the top side of the formed end through the punch, unexpectedly results in even higher speed forming by eliminating undesirable air currents and pressure differentials between the top and bottom surfaces of the formed end after vacuum is released.

The automatic lubrication system provides an effective means for venting virtually all pneumatic air cushions in the upper and lower die assemblies to prevent the formation of stagnant air and cumulative oil which may leak through the seals and undesirably coat the ends being formed. The feature of lubricating the seals with a fine oil mist, without injectors, results in a minimal but adequate use of lubricating oil to ensure reliable seal lubrication and operation.

The ability to use press power to lift one or both of the stripper plate or cut edge holder plate through the homing blocks and lift pins advantageously enables easy access to the bottom die components or the stock feed slot for ease of maintenance and repair in minimal time.

In my related applications Ser. No. 530,506 and Ser. No. 104,745, the term "die set" is used to refer to a set of die assemblies within a pocket of a press or to the complete die system. It will be appreciated that a different, art-specific meaning of this same term is a set of bases on which most of the working components are mounted, for example punch shoe 18 and die shoe 22 in combination with guide posts 42 as described in this application; none of these three applications uses the term in that art-specific sense.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

I claim:

1. In a method for forming metallic can ends between upper and lower die assemblies, each of said die assemblies having relatively vertically reciprocal die components which coact with die components of the other die assembly, comprising cutting metal blanks from a sheet of metal stock between said upper die assembly and a cutting edge and forming said blanks into ends between said die assemblies, the improvement comprising ejecting said ends from between said die assemblies at a predetermined position above the uppermost position of said lower die assembly and below said metal stock and said upper die assembly to thereby prevent passing of said ends through said metal stock, wherein said ends are blown from between said die assemblies with at least one air jet into an ejection slot located immediately and substantially coelevationally adjacent said predetermined position, said ends being blow into said ejection slot substantially at the instant said ends are released from between said die assemblies.

2. In an apparatus for forming metallic can ends in a press comprising upper and lower die assemblies, each of said die assemblies having relatively vertically reciprocal die components which coact with die components of the other die assembly, a cutting edge with which said upper die assembly cooperates to cut blanks from a sheet of metal stock, after which said ends are formed from said blanks between said die assemblies and then are released from said die assemblies, the improvement comprising means for ejecting said ends from between said die assemblies at a predetermined position above the uppermost position of said lower die assembly and below said metal stock and said upper die assembly to thereby prevent passing of said ends through said metal stock, said means for ejecting said ends including at least one air jet and including an ejection slot located immediately and substantially coelevationally adjacent said predetermined position, said ejecting means including means for blowing air through said air jet substantially at the instant said ends are released from said die assemblies, said ends thereby being blown horizontally from between said die assemblies into said ejection slot.

3. The apparatus of claim 2, wherein said press is a single action press.

4. The apparatus of claim 2, wherein at least said die assemblies is spring mounted.

5. The apparatus of claim 2, wherein at least one of said die assemblies is air mounted.

6. The apparatus of claim 2, wherein at least one of said die assemblies is rubber mounted.

7. The apparatus of claim 2, wherein said upper and lower die assemblies form a slot which guides each end into said ejection slot.

8. The apparatus of claim 2, further comprising means for moving selected ones of die components such that the die components coact with each other under resilient bias to form said ends from said blanks.

9. The apparatus of claim 8, wherein said resilient biasing means includes pneumatic cushion means, pressurized fluid supply means connected for supplying pressurized fluid to said pneumatic cushion means, and seal means provided between said selected ones of said upper and lower die components and others of said upper and lower die components located adjacent said selected ones to establish said pneumatic cushion means.

10. Apparatus of claim 9, further comprising manifold means connected to said pneumatic cushion means to distribute pressurize fluid to the pneumatic cushions and inlet passageway means formed in the upper and lower die assemblies for delivering said pressurized fluid to said pneumatic cushion means from said manifold means.

11. Apparatus of claim 10, further comprising outlet passageway means formed in the upper and lower assemblies for discharging pressurized fluid from said pneumatic cushion means, and outlet valve means for opening and closing said outlet passageway means, said outlet valve means being normally closed during end forming operations to prevent depressurization of said pneumatic cushion means.

12. Apparatus of claim 11, further comprising inlet valve means for opening and closing the inlet passageway means, said inlet valve means open during end forming operations to pressurize said pneumatic cushions.

13. Apparatus of claim 12, further comprising means for lubricating the seal means defining the pneumatic cushion means, said lubricating means comprising a lubrication circuit including:

i) a lubrication reservoir means;

ii) a mister means for atomizing the lubricant received from the reservoir means to form lubricated air;

iii) means for regulating the pressure of the lubricated air; and iv) means for supplying said pressure regulated lubricated air to the pneumatic cushions through the inlet valves and inlet passageways, said lubricated air being exhausted from the pneumatic cushion means through the outlet valve means and outlet passageways.

14. Apparatus of claim 13, further comprising a coalescing filter connected to the outlet valve means for filtering remaining lubricant from the lubricated air prior to discharge to atmosphere.

15. Apparatus of claim 14, wherein said pressure regulating means includes individual dedicated pressure regulators for lubricating the seal means respectively associated with the different pneumatic cushions.

16. Apparatus of claim 15, wherein said pressure regulating means establishes lubricated air pressure at a predetermined value less than the pressure of lubricant supplied to the pressure regulating means from the reservoir means.

17. Apparatus of claim 9, wherein said pneumatic cushions are located to respectively resiliently bias the lower draw ring, lift ring and the re-form piston in the lower die assembly, and the upper draw ring in the upper die assembly.

18. Apparatus of claim 17, further comprising means for providing communication between the upper side of the formed end with ambient air pressure during release of a vacuum applied to the underside of the formed end, and means for enabling communication between the underside of the formed end with ambient air pressure immediately after said release of vacuum.

19. Apparatus of claim 18, further comprising means for locating the upper forming surfaces of the lower die components coelevational with each other to define the bottom of an exit slot between the upper and lower dies which bottom is coelevational with the bottom surface of an entrance end of an ejection slot formed immediately adjacent the exit slot, and means for directing pressurized fluid against a side of the formed end which is opposite the ejection slot to rapidly eject the formed end from between the upper and lower die assemblies.

20. Apparatus of claim 2, further comprising means for locating the upper forming surfaces of all said lower die components co-elevational with each other, after forming, and in co-elevational alignment with said ejection slot.

21. In a method for forming metallic can ends between upper and lower die assemblies, each of said die assemblies having relatively vertically reciprocal die components which coact with die components of the other die assembly, comprising cutting metal blanks from a sheet of metal stock between said upper die assembly and a cutting edge and forming said blanks into ends between said die assemblies, the improvement comprising ejecting said ends from between said die assemblies at a predetermined position above an uppermost position of said lower die assembly and below said metal stock and said upper die assembly to thereby prevent passing of said ends through said metal stock, wherein said ends are blown from between said die assemblies with at least one air jet into an ejection slot located immediately and substantially coelevationally adjacent said predetermined position and wherein said upper and lower die assemblies form a slot which guides each said end into said ejection slot.

22. In a method for forming metallic can ends between upper and lower die assemblies, each of said die assemblies having relatively vertically reciprocal die components which coact with die components of the other die assembly, comprising cutting metal blanks from a sheet of metal stock between said upper die assembly and a cutting edge and forming said blanks into ends between said die assemblies, the improvement comprising ejecting said ends from between said die assemblies at a predetermined position above an uppermost position of said lower die assembly and below said metal stock and said upper die assembly to thereby prevent passing of said ends through said metal stock, wherein said ends are blown from between said die assemblies with at least one air jet into an ejection slot located immediately and substantially coelevationally adjacent said predetermined position, wherein said upper and lower die assemblies form a slot which guides each said end into said ejection slot, and wherein said at least one air jet is blowing on each said end while at least the periphery of said end is contacted at upper and lower portions thereof by portions of the upper and lower die assemblies respectively, so as to impart horizontal movement to said end substantially at the instant said end is released from said die assemblies.

23. In an apparatus for forming metallic can ends in a press comprising upper and lower die assemblies, each of said die assemblies having relatively vertically reciprocal die components which coact with die components of the other die assembly, a cutting edge with which said upper die assembly cooperates to cut blanks from a sheet of metal stock, after which said ends are formed from said blanks between said die assemblies, the improvement comprising means for ejecting said ends from between said die assemblies at a predetermined position above an uppermost position of said lower die assembly and below said metal stock and said upper die assembly to thereby prevent passing of said ends through said metal stock, wherein said ends are blown from between said die assemblies with at least one air jet into an ejection slot located immediately and substantially coelevelationally adjacent said predetermined position, wherein said upper and lower die assemblies form a slot which guides each said end into said ejection slot, and wherein said at least one air jet is blowing on each said end while at least the periphery of said end is contacted at upper and lower portions thereof by portions of the upper and lower die assemblies, respectively, so as to impart horizontal movement to said end substantially at the instant said end is released from said die assemblies.

* * * * *